US007690944B2

(12) United States Patent
Matsumura et al.

(10) Patent No.: US 7,690,944 B2
(45) Date of Patent: Apr. 6, 2010

(54) CONNECTOR ASSEMBLY, RECEPTACLE TYPE CONNECTOR, AND INTERFACE APPARATUS

(75) Inventors: Shigeru Matsumura, Tokyo (JP); Kazutaka Osawa, Tokyo (JP); Hiroyuki Hama, Tokyo (JP); Yuichiro Izumi, Tokyo (JP); Eiichiro Takemasa, Kanagawa (JP)

(73) Assignees: Advantest Corporation, Tokyo (JP); Tyco Electronics Japan G.K., Kanagawa (JP)

( * ) Notice: Subject to any disclaimer, the term of this patent is extended or adjusted under 35 U.S.C. 154(b) by 279 days.

(21) Appl. No.: 11/896,241

(22) Filed: Aug. 30, 2007

(65) Prior Publication Data

US 2008/0076298 A1 Mar. 27, 2008

(30) Foreign Application Priority Data

Sep. 22, 2006 (JP) ..... 2006-257929

(51) Int. Cl.
*H01R 9/05* (2006.01)
*H01R 25/00* (2006.01)

(52) U.S. Cl. ..... 439/578; 439/638

(58) Field of Classification Search ..... 439/578, 439/638, 584

See application file for complete search history.

(56) References Cited

U.S. PATENT DOCUMENTS

| | | | | |
|---|---|---|---|---|
| 4,930,370 | A | 6/1990 | Yoshida | |
| 5,509,827 | A * | 4/1996 | Huppenthal et al. | 439/638 |
| 5,994,894 | A | 11/1999 | Fujita | |
| 6,558,201 | B1 * | 5/2003 | Begley et al. | 439/638 |
| 6,796,844 | B1 * | 9/2004 | Edwards, III | 439/638 |
| 7,121,896 | B2 * | 10/2006 | Norris et al. | 439/668 |
| 7,230,437 | B2 * | 6/2007 | Eldridge et al. | 324/754 |
| 2005/0033949 | A1 | 2/2005 | Herrmann et al. | |
| 2005/0225346 | A1 | 10/2005 | Saito et al. | |
| 2008/0038962 | A1 | 2/2008 | Neumetzler et al. | |

FOREIGN PATENT DOCUMENTS

| | | | |
|---|---|---|---|
| DE | 3406741 | A1 | 8/1985 |
| DE | 103 23 413 | B4 | 12/2004 |
| DE | 10 2004 043 763 | B3 | 2/2006 |
| DE | 600 31 323 | T2 | 8/2007 |
| EP | 0 153 631 | B1 | 9/1985 |
| EP | 1 045 489 | B1 | 10/2000 |
| JP | 59-146882 | U | 10/1984 |
| JP | 64-29790 | U | 2/1989 |
| JP | 2000-65894 | A | 3/2000 |
| JP | 2003-197321 | A | 7/2003 |

* cited by examiner

*Primary Examiner*—Briggitte R Hammond
(74) *Attorney, Agent, or Firm*—Birch, Stewart, Kolasch, & Birch LLP

(57) ABSTRACT

A connector assembly, for electrically connecting electrical cables 7 to a test head 4, comprises a plurality of types of cable side connectors 8 respectively attached to one end of the electrical cable 7; and a intermediate connector 6 to which the plurality of types of cable side connectors 8 are connected in a detachable manner, and the intermediate connector 6 having a first engagement part 501 having a shape with which all types of cable side connectors 8 can be engaged and an output terminal 602 able to be engaged with a test head side connector 41 electrically connected to a pin electronics board of the test head 4.

13 Claims, 21 Drawing Sheets

CONNECTOR ASSEMBLY, RECEPTACLE TYPE CONNECTOR, AND INTERFACE APPARATUS

TECHNICAL FIELD

The present invention relates to a connector assembly for electrically connecting an electrical cable to a circuit board, a receptacle type connector forming part of that connector assembly, and an interface apparatus for interconnecting electrical connections between a test head and devices under test in an electronic device test apparatus.

BACKGROUND ART

In the process of production of semiconductor integrated circuit devices and other various electronic devices (hereinafter also referred to as "IC devices") , an electronic device test apparatus is used for testing performances and functions of IC devices in the state formed on a wafer or in a packaged state.

This electronic device test apparatus uses a handler or prober to electrically connect IC devices to a test head and uses a tester to run tests on them. The test head is provided on top with an interface apparatus for interconnecting electrical connections between the IC devices and the test head (hereinafter simply referred to as a "HiFix (High Fidelity Tester Access Fixture)" or "wafer mother board").

A conventional HiFix is provided at its topmost part with socket boards on which sockets having a large number of contact pins electrically contacting input/output terminals of IC devices are mounted and at its bottommost part with an interconnection board electrically connected to the socket boards through electrical cables. The interconnection board has the ends of the electrical cables directly soldered to it. The HiFix is electrically connected through this interconnection board to the test head.

To streamline the tests, one HiFix is provided with a large number of (for example, 32, 64, or 128) sockets. Further, several electrical cables are led out from each socket.

For that reason, when fabricating a HiFix, several thousand electrical cables have to be soldered to the interconnection board. This consumes tremendous manpower and requires skilled workers and therefore has become a factor behind higher costs in a HiFix.

To deal with this problem, it may be considered effective to change the interconnection board to a detachable connector structure. However, the electrical cables electrically connecting the socket boards and the interconnection board include, for example, coaxial cables for transmitting high speed signals, single wires for supplying power or transmitting low speed signals, and others of a plurality of types of cables. For that reason, it is necessary to prepare a plurality of types of connectors corresponding to all of the cables and therefore the costs of HiFix have not been able to be sufficiently reduced.

DISCLOSURE OF THE INVENTION

The present invention has as its object the provision of a connector assembly superior in general applicability.

To achieve the above object, according to the present invention, there is provided a connector assembly comprising a plurality of types of cable side connectors respectively attached to one end of electrical cable; and an intermediate connector to which the plurality of types of cable side connectors are detachably connected, and wherein the intermediate connector has a first engagement part having a shape with which all types of the cable side connectors can be engaged.

In the present invention, the intermediate connector is provided with a first engagement part having a shape with which the plurality of types of cable side connectors can be engaged. Due to this, the plurality of types of cables can be handled by a single type of intermediate connector and the cost of the interface apparatus can be reduced.

While not particularly limited to this in the invention, preferably the plurality of types of cable side connectors include a coaxial connector attached to one end of a coaxial cable having a center conductor and a ground wire; and a single-wire connector attached to one end of a single wire, and the first engagement part of the intermediate connector has a shape with which the coaxial connector can engage and the single-wire connector can engage.

While not particularly limited to this in the invention, preferably the intermediate connector has a connector body at which a plurality of the first engagement parts are provided.

While not particularly limited to this in the invention, preferably the coaxial cable has a center conductor and a ground wire, the coaxial connector has a signal terminal to which the center conductor is electrically connected and first and second ground terminals to which the ground wire is electrically connected, and the single-wire connector has first to third single-wire terminals to which three single wires are electrically connected.

While not particularly limited to this in the invention, preferably the first engagement part has first to third output terminals, when the coaxial connector is engaged with the first engagement part, the signal terminal is electrically connected to the first output terminal and the first and second ground terminals are electrically connected to the second and third output terminals, and, when the single-wire connector is engaged with the first engagement part, the first to third single-wire terminals are electrically connected to the first to third output terminals.

While not particularly limited to this in the invention, preferably the first engagement part has a locking deviece which fastens the coaxial connector or the single-wire connector engaged with the first engagement part and the coaxial connector and the single-wire connector have an engagement projection for engagement by the locking device.

While not particularly limited to this in the invention, preferably the connector body of the intermediate connector has a second engagement part with which a board side connector electrically connected to a circuit board can be engaged.

Further, the receptacle type connector of the present invention is a receptacle type connector able to receive either a coaxial cable plug type connector to which a coaxial cable is connected or a single-wire plug type connector to which a plurality of single wires are connected. This receptacle type connector (hereinafter simply referred to as a "receptacle") comprises a first group of contacts for electrical connection with a coaxial cable plug type connector (hereinafter simply referred to as a "coaxial cable plug") and a second group of contacts for electrical connection with a single-wire plug type connector (hereinafter simply referred to as a "single-wire plug"). The first group of contacts includes a first signal contact and a pair of ground contacts positioned symmetrically about the first signal contact. Further, the second group of contacts includes the first signal contacts and a pair of second signal contacts positioned at two points which are in an equal distance from the first signal contact. Further, the receptacle of the present invention comprises an insulative housing for holding the first group of contacts and the second group of contacts. Further, the receptacle of the present invention has the second signal contacts of the second group of contacts arranged at either side of a line connecting the pair of ground contacts as seen from the engagement face.

Here, the ability to receive either a coaxial cable plug or a single-wire plug means the ability of one engagement recess to receive either a coaxial cable plug or a single-wire plug. A mode in which an engagement recess for receiving a coaxial cable plug and an engagement recess for receiving a single-wire plug are separately provided is excluded. In the present invention an engagement recess can be formed by the insulative housing. By arranging the first group of contacts and the second group of contacts in each engagement recess, one engagement recess can receive either a coaxial cable plug or single-wire plug.

The receptacle of the present invention, by employing the above configuration, enables the first signal contact of the first group of contacts to also serve as one signal contact in the second group of contacts. That is, the receptacle of the present invention, as an element of the configuration being able to receive either a coaxial cable plug or a single-wire plug by one engagement recess, has the first group of contacts and the second group of contacts share one signal contact. By reducing the number of contacts in this way, it is possible to reduce the area occupied by the signal contacts in the engagement recess. This means that the contacts can be arranged at a higher density in the engagement recess and, when arranging a large number of contact units composing of the first group of contacts and the second group of contacts, the advantage is given that the overall configuration can be made more compact. Further, by having the first group of contacts and the second group of contacts share a signal contact, there is the advantage that it is possible to make the external connection contacts connected with the signal contact a single contact. This fact also contributes to greater compactness of the receptacle.

Next, in the first group of contacts corresponding to the coaxial cable plug, the pair of ground contacts are arranged at symmetric positions about the first signal contact. In the first group of contacts, the pair of ground contacts and the signal contact may also be arranged at the vertexes of an isosceles triangle. However, this arrangement would be way off a coaxial structure, so the characteristic impedance would not be able to be matched with a coaxial cable. Therefore, to realize a pseudo coaxial structure, the pair of ground contacts are arranged at positions symmetric with respect to the first signal contact. As a pseudo coaxial structure, for example, the pair of ground contacts may be made parallel plate-shaped members.

The second group of contacts includes two second contacts arranged in equal distance from the first signal contact shared by the first group of contacts. However, in the receptacle of the present invention, the second signal contacts of the second group of contacts are arranged at either side of the line connecting the pair of ground contacts of the first group of contacts. Therefore, in the second group of contacts, the first signal contact and the pair of second contacts are arranged at the vertexes of an isosceles triangle. Note that which side to be arranged at is determined only judging from the engagement face.

In the receptacle of the present invention, the first signal contact and the second signal contacts preferably have the same shapes. The three contacts of the single-wire plug preferably are the same in shape as each other to reduce the number of parts. Therefore, preferably the first signal contact and the second signal contacts to be connected to are also the same in shape as each other.

Here, the first signal contact and the pair of ground contacts forming the first group of contacts have to be electrically isolated from each other. The first signal contact and the pair of second signal contacts forming the second group of contacts also have to be electrically isolated from each other. However, the ground contacts of the first group of contacts and the second signal contacts of the second group of contacts may be electrically connected with each other. Therefore, in the receptacle of the present invention, the ground contacts and the second signal contacts positioned at the same side of the first signal contact are preferably formed integrally. Compared with making the members independent from each other, the number of parts can be reduced, so the contact unit can be configured at a high density. Due to this configuration, as explained later, the ground loop interference can be reduced. Further, by configured in this way, it is possible to reduce the number of external connection contacts for four contacts to two. Combined with the one external connection contact by sharing the above-mentioned signal contact, a total of three external connection contacts become sufficient.

The present invention can make a receptacle comprising a plurality of contact units consisting of the first group of contacts and the second group of contacts. In this case, the contact units are preferably arranged in a zigzag configuration. In the same way as a differential transmission connector, the ground contacts and the signal contacts are alternately arranged. As a result, a drop in the high frequency characteristics can be avoided.

The present invention can also be grasped as a connector assembly comprising a receptacle able to receive either a coaxial cable plug or single-wire plug and the coaxial cable plug or the single-wire plug electrically connected to the receptacle. This receptacle can employ any of the above-mentioned configurations.

Further, to achieve the above object, according to the present invention, there is provided an interface apparatus mounted on a test head for testing a device under test and interconnecting an electrical connection between the device under test and the test head, wherein the interface apparatus comprises the above connector assembly, the intermediate connector is provided at a position adjoining the test head in the interface apparatus, the other end of the electrical cable is electrically connected to a measurement board electrically contacting the device under test, and the board side connector is electrically connected to the test head.

While not particularly limited to this in the invention, the intermediate connector preferably has a plurality of the first engagement parts and has a plurality of the second engagement parts.

While not particularly limited to this in the invention, preferably the interface apparatus are provided with a plurality of the intermediate connectors.

While not particularly limited to this in the invention, preferably the intermediate connector has a positioning pin projecting out toward the test head side connector and the test head side connector has a positioning hole facing the positioning pin.

While not particularly limited to this in the invention, preferably the device under test is a packaged semiconductor device and the measurement board is a socket board on which a socket for electrical contact with the semiconductor device is mounted.

While not particularly limited to this in the invention, preferably the device under test is a semiconductor device formed on a wafer and the measurement board is a probe card on which probe needles for electrical contact with the semiconductor device are mounted.

To achieve the above object, according to the present invention, there is provided an electronic device test apparatus for testing a device under test, wherein the electronic device test apparatus comprises a test head electrically connected to the device under test at the time of the test and the interface apparatus electrically connected to the device under test, mounted on the test head, and interconnecting electrical connection between the device under test and the test head.

BEST MODE FOR CARRYING OUT THE INVENTION

Below, embodiments of the present invention will be explained based on the drawings.

First Embodiment

Figure 1:
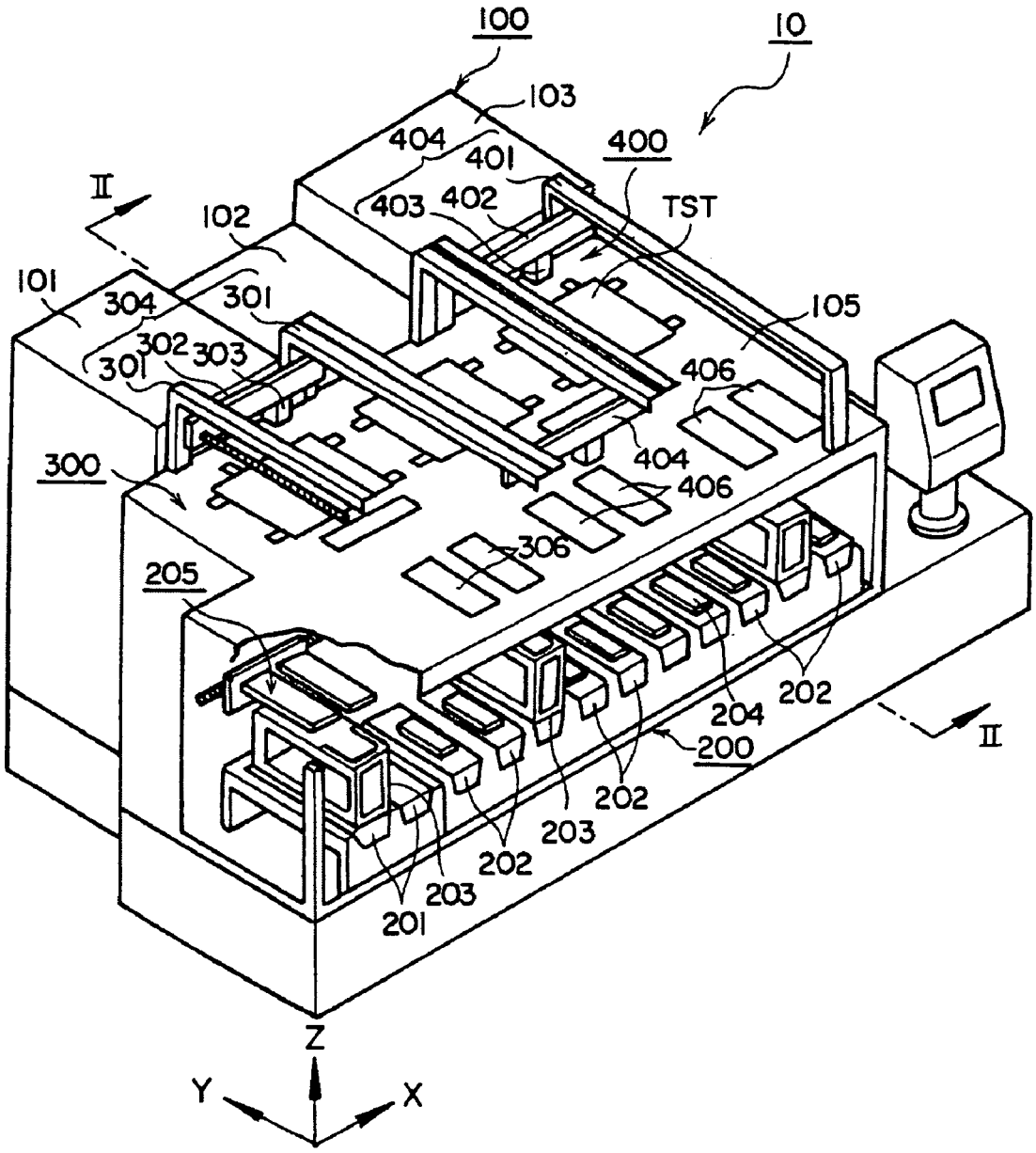
FIG. 1 is a perspective view showing an entire electronic device test apparatus according to a first embodiment of the present invention.
Figure 2:
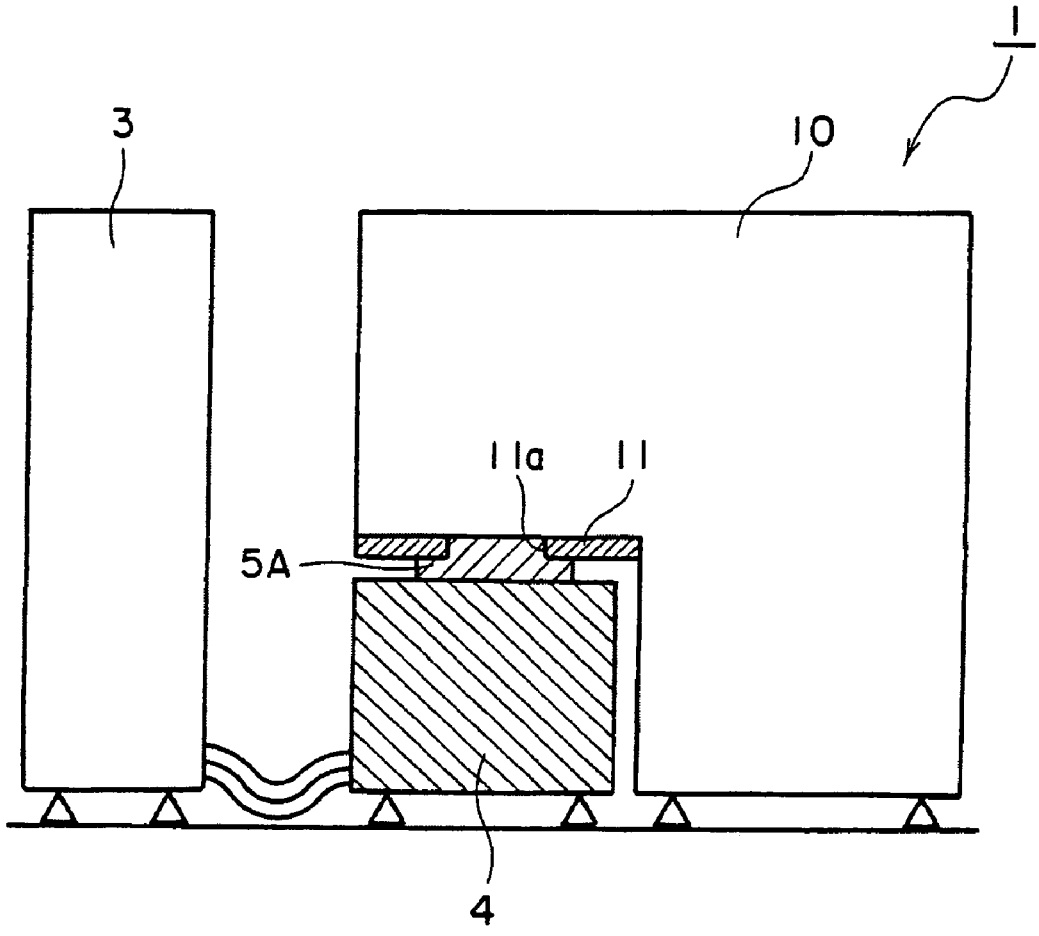
FIG. 2 is a schematic cross-sectional view along the line II-II of FIG. 1.
Figure 3:
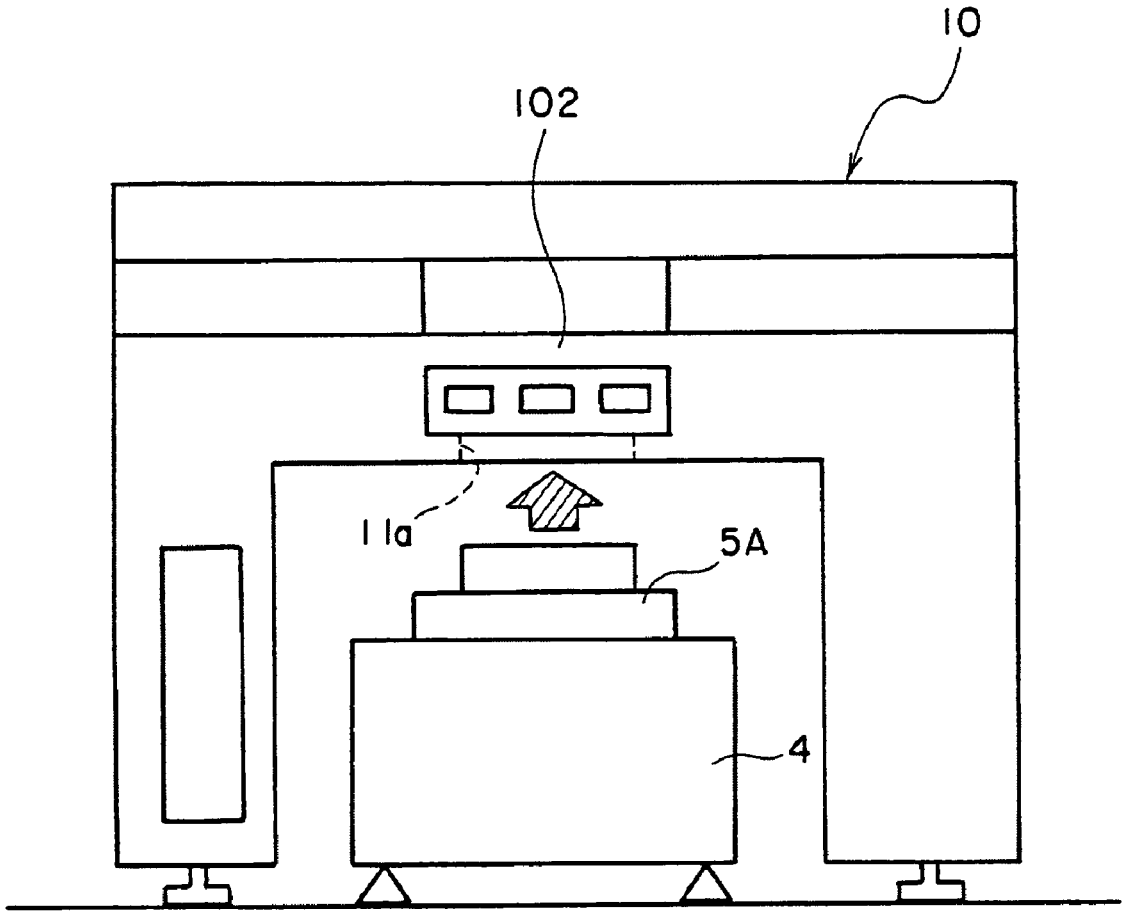
FIG. 3 is a back view of the electronic device test apparatus shown in FIG. 1.

FIG. 1 is a perspective view showing an entire electronic device test apparatus according to the present embodiment, FIG. 2 is a schematic sectional view along the line II-II of FIG. 1, and FIG. 3 is a back view of the electronic device test apparatus shown in FIG. 1. First, the overall configuration of an electronic device test apparatus according to the present embodiment will be explained in brief with reference to FIG. 1 to FIG. 3.

The electronic device test apparatus 1 according to the present embodiment, as shown in FIG. 1 and FIG. 2, comprises a handler 10 for handling IC devices under test, a test head 4 to which IC devices under test are electrically connected, and a tester 3 for sending test signals to this test head 4 to run tests on the IC devices under test.

The handler 10 is a apparatus for supplying IC devices to the test head 4 in the state with the IC devices under test given high temperature or low temperature thermal stress and classifying the IC devices based on the test results after the tests are completed and comprises a storage unit 200, a loader unit 300, a chamber unit 100, and an unloader unit 400.

Customer trays holding a large number of IC devices under test are stored in the storage unit 200. In the loader unit 300, pre-test IC devices are reloaded from such a customer tray to a test tray (tray circulated inside handler 10), then the test tray is conveyed into the chamber unit 100. In the chamber unit 100, the IC devices are given predetermined thermal stress, then the IC devices are pushed against the test head 4 in the state carried on the test tray, the IC devices are electrically brought into contact with the sockets 99, and the IC devices are tested. The post-test IC devices are conveyed from the chamber unit 100 to an unloader unit 400 and are reloaded on customer trays in accordance with the test results.

The storage unit 200 is provided with pre-test IC stockers 201 for storing customer trays holding pre-test IC devices and post-test IC stockers 202 storing customer trays holding IC devices classified in accordance with the test results.

The pre-test IC stockers 201 and the post-test IC stockers 202 have tray support frames 203 and elevators 204 able to ascend and descend in the tray support frames 203. The tray support frames 203 support pluralities of not shown customer trays stacked together. These customer trays are able to move up and down by the elevators 204.

The pre-test IC stockers 201 hold stacks of customer trays holding pre-test IC devices. As opposed to this, the post-test IC stockers 202 hold stacks of customer trays holding post-test IC devices stored in accordance with the test results.

The customer trays stored in the pre-test IC stockers 201 are carried into the loader unit 300. In this loader unit 300, pre-test IC devices are reloaded from the customer trays to test trays.

The loader unit 300 is provided with an XY-conveyance system 304 reloading IC devices under test from the customer trays to the test trays. This XY-conveyance system 304 is, as shown in FIG. 1, provided with two rails 301 laid on a main frame 105, a movable arm 302 able to move by these two rails 301 back and forth between the customer trays and the test trays (this direction being defined as the Y-direction), and a movable head 303 supported by this movable arm 302 and able to move along the movable arm 302 in the X-direction.

The movable head 303 of this XY-conveyance system 304 has pickup heads able to pick up and hold IC devices under test. For example, the movable head 303 has eight pickup heads mounted on it and can reload eight IC devices under test at a time from customer trays to test trays.

The main frame 105 of the loader unit 300 has a pair of windows 306, 306 formed in it so that customer trays carried to the loader unit 300 can approach the top surface of the main frame 105. While the illustration is omitted, each window 306 is provided with holding hooks for holding a customer tray and a customer tray is held at a position where the top surface of the customer tray approaches the surface of the main frame 105 through the window 306.

Further, below each window 306, an elevator table for raising and lowering a customer tray is provided. This elevator table lowers a customer tray emptied by unloading of pre-test IC devices and transfers it to the tray transport arm 205.

The chamber unit 100 comprises a constant temperature tank 101 for applying the desired high temperature or low temperature thermal stress to the IC devices under test loaded on a test tray; a test chamber 102 pushing the IC devices under test in a state given temperature stress in this constant temperature tank 101 to the test head 4; and a thermal stress-relieving tank 103 relieving the temperature stress applied from the post-test IC devices.

When applying a high temperature at the constant temperature tank 101, in the thermal stress-relieving tank 103, air is blown against the IC devices under test to cool them and return them to room temperature. On the other hand, when using the constant temperature tank 101 to apply a low temperature of for example about −30° C., in the thermal stress-relieving tank 103, the IC device under tests are heated by hot air or a heater etc. to return them to a temperature of an extent where no condensation will occur. Further, the IC devices under test from which the stress was relieved are conveyed to the unloader unit 400.

As shown in FIG. 2 and FIG. 3, the base unit 11 of the handler 10 forming the bottom surface of the test chamber 102 is formed with an opening 11*a* at its substantial center. In the opening 11*a*, a HiFix 5A mounted on the top of the test head 4 is connected.

When a test tray is carried to the sockets 99 on this HiFix 5A, a Z-axial drive system (not shown) pushes the IC devices under test to the HiFix 5 through a pusher (not shown) to make the input/output terminals of the large number of IC devices under test on the test tray electrically contact the contact pins of the sockets 99. Further, the tester 3 sends test signals through the test head 4 to the IC devices under test and runs tests on the IC devices under test. The results of the tests are stored at addresses determined for example by the identification number assigned to the test tray and the numbers of the IC devices under test assigned inside the test tray. A test tray finished being tested is conveyed to the unloader unit 400 after the temperatures of the IC devices return to room temperature in the thermal stress-relieving tank 103.

The unloader unit 400 is also provided with an XY-conveyance system 404 of the same structure as the XY-conveyance system 304 provided at the loader unit 300. This XY-conveyance system 404 is used to reload post-test IC devices from a test tray conveyed to the unloader unit 400 to the customer trays.

The main frame 105 of the unloader unit 400 is provided with two pairs of windows 406, 406 arranged so that customer trays carried to the unloader unit 400 can approach the top surface of the main frame 105. While the illustration will be omitted, each window 406 is provided with holding hooks for holding a customer tray and a customer tray is held at a position where the top surface of the customer tray approaches the surface of the main frame 105 through the windows 406.

Further, below each window 406, an elevator table for raising and lowering a customer tray is provided. This elevator table lowers a customer tray filled by post-test IC devices and transfers them to the tray transport arm 205.

As shown in FIG. 1, the storage unit 200 is provided with a tray transport arm 205 able to move over the stockers 201, 202. This tray transport arm 205 can transport customer trays between the loader unit 300, the unloader unit 400 and the stockers 201, 202.

Figure 4:
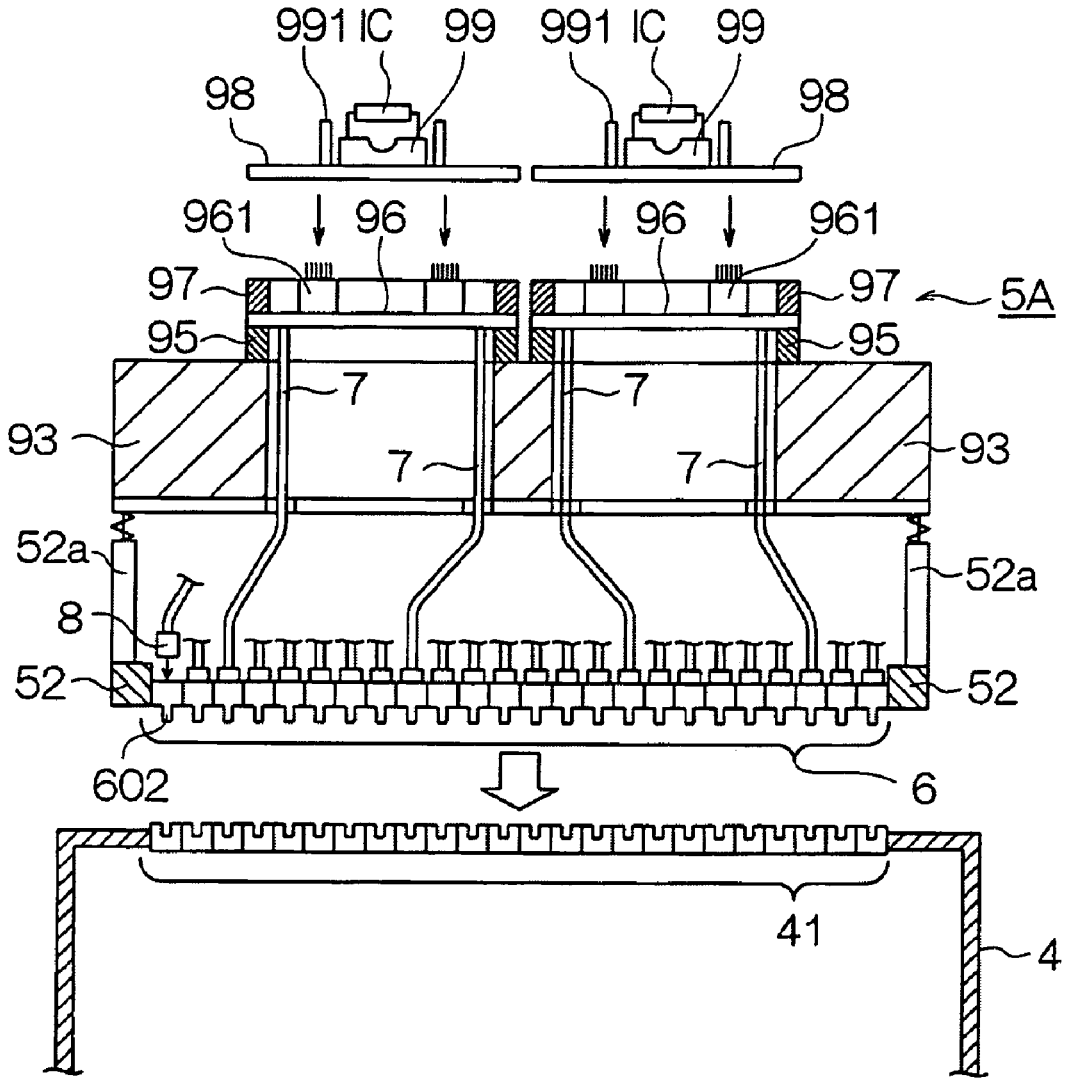
FIG. 4 is a cross-sectional view showing a HiFix and a test head according to a first embodiment of the present invention.
Figure 5:
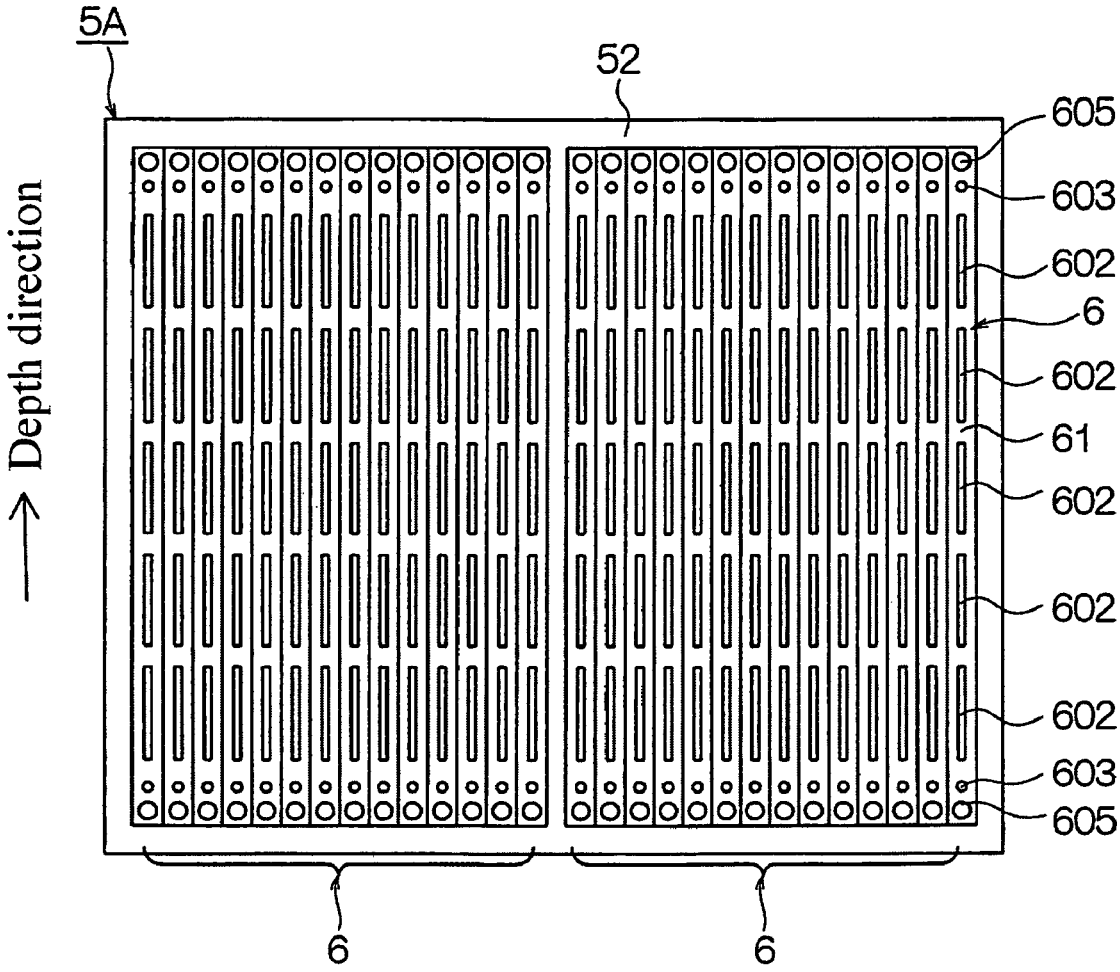
FIG. 5 is a plan view of a HiFix according to the first embodiment of the present invention seen from the bottom side.
Figure 6:
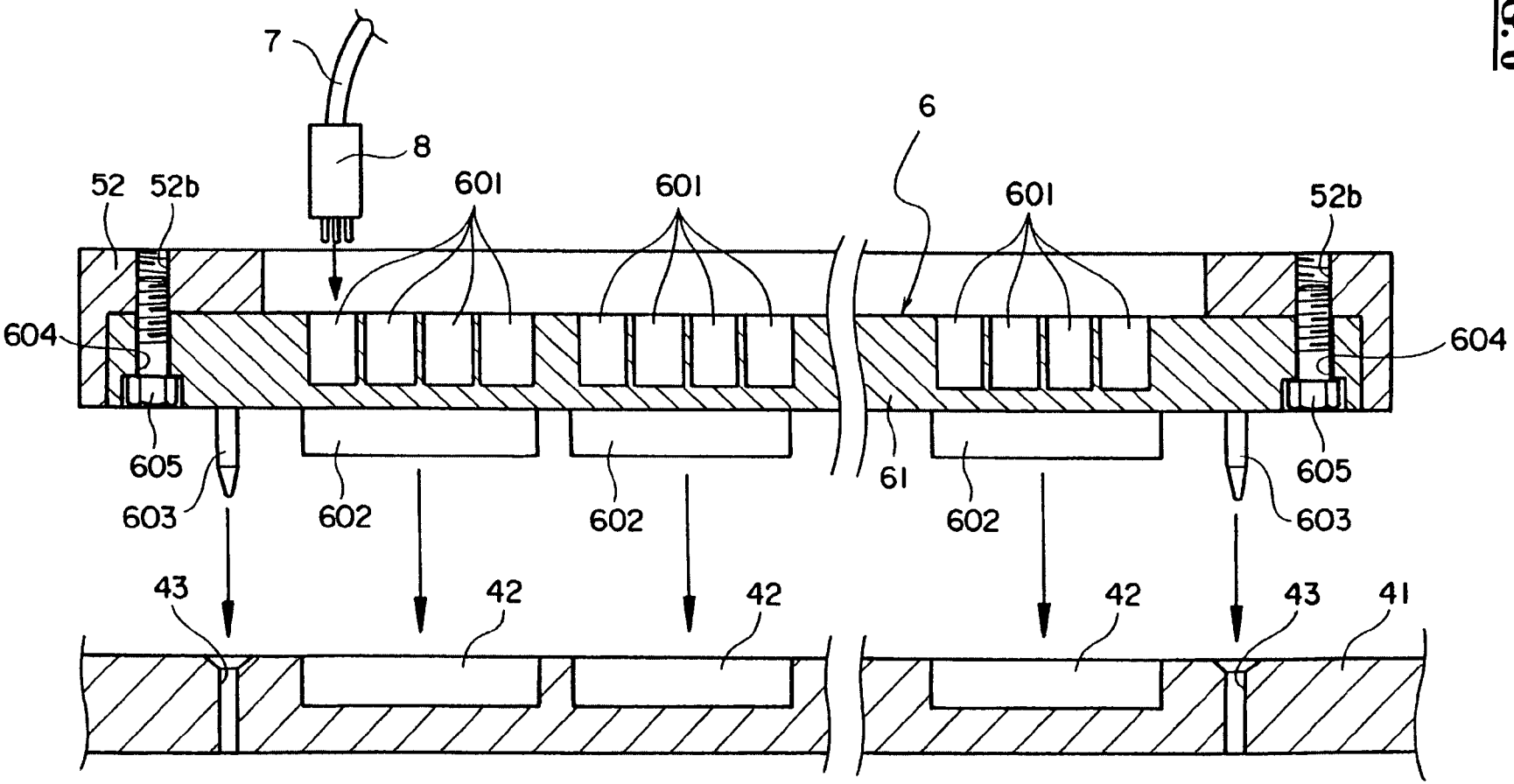
FIG. 6 is a cross-sectional view showing a device side connector, an intermediate connector, and a test head side connector in the first embodiment of the present invention.
Figure 7:
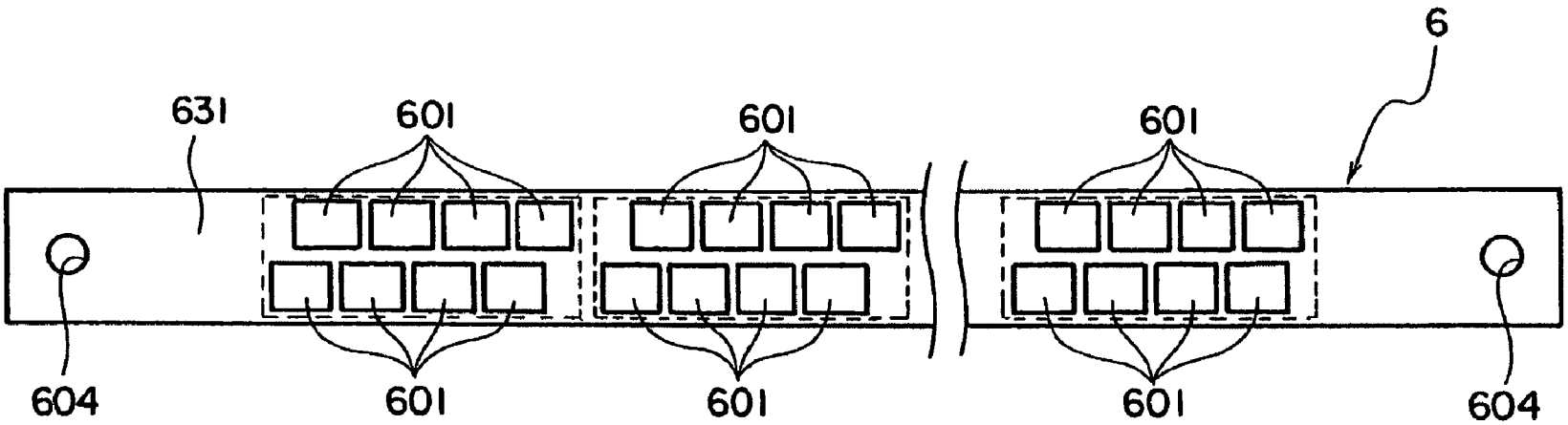
FIG. 7 is a top plan view showing an intermediate connector in the first embodiment of the present invention.

FIG. 4 is a cross-sectional view showing a HiFix and a test head according to the present embodiment, FIG. 5 is a plan view of a HiFix according to the present embodiment as seen from below, FIG. 6 is a cross-sectional view showing a device side connector, an intermediate connector, and a test head side connector in the present embodiment, and FIG. 7 is a top plan view showing an intermediate connector in the present embodiment.

The HiFix 5A according to the present embodiment, as shown in FIG. 4, is an SBC (Socket Board Change) type of HiFix enabling a change in kind of IC devices under test to be handled by replacing just the topmost part socket boards 98. This HiFix 5A, as shown in the drawing, is mounted on the top of the test head 4 through test head side connectors 41 (board side connectors) provided on the top of the test head 4 and intermediate connectors (receptacles) 6.

The HiFix 5A, as shown in FIG. 5, has a plurality of (28 in the example shown in FIG. 5) intermediate connectors 6. These intermediate connectors 6 are positioned at the bottom-most part of the HiFix 5A and are fastened to a frame-shaped frame 52 in the state arranged substantially in parallel along the depth direction of the HiFix 5A.

Each intermediate connector 6 has a substantially square cross-section rod-shaped housing 61 made of an insulating material as shown in FIG. 6 and FIG. 7. The top surface of the housing 61 of each intermediate connector 6 is formed with a plurality of engagement holes 601 with which a device side connector 8 attached to an end of an electrical cable 7 may be engaged. In the present embodiment, a plurality of engagement holes 601 are arranged in two rows along the depth direction of the HiFix 5A.

By forming a plurality of engagement holes 601 at a single intermediate connector 6, it is possible to reduce the number of intermediate connectors 6 attached to the frame 52, so the work efficiency of attaching the intermediate connectors 6 to the frame 52 of the HiFix 5A is improved. Further, the work efficiency at the time of maintenance of the intermediate connectors 6 is also improved.

Further, by dividing the intermediate connectors 6 into several parts (28 in the example shown in FIG. 5), compared with the case of forming all engagement holes 601 in a single intermediate connector, it becomes possible to detach only the intermediate connectors to be maintained, so the work efficiency in maintenance of the intermediate connectors 6 is improved.

In the present embodiment, as shown in FIG. 7, a plurality of engagement holes 601 are arranged in a zigzag configuration in two rows across the entire depth of the HiFix 5A per one intermediate connector 6. Note that the invention is not particularly limited to this. For example, it is also possible to arrange the plurality of engagement holes 601 in a single row or three rows or more across the entire depth of the HiFix 5A or, for example, arrange M×N number of engagement holes 601 in a M-row N-column array (where, M and N are all natural numbers, at least one of which is 2 or more).

Figure 8:
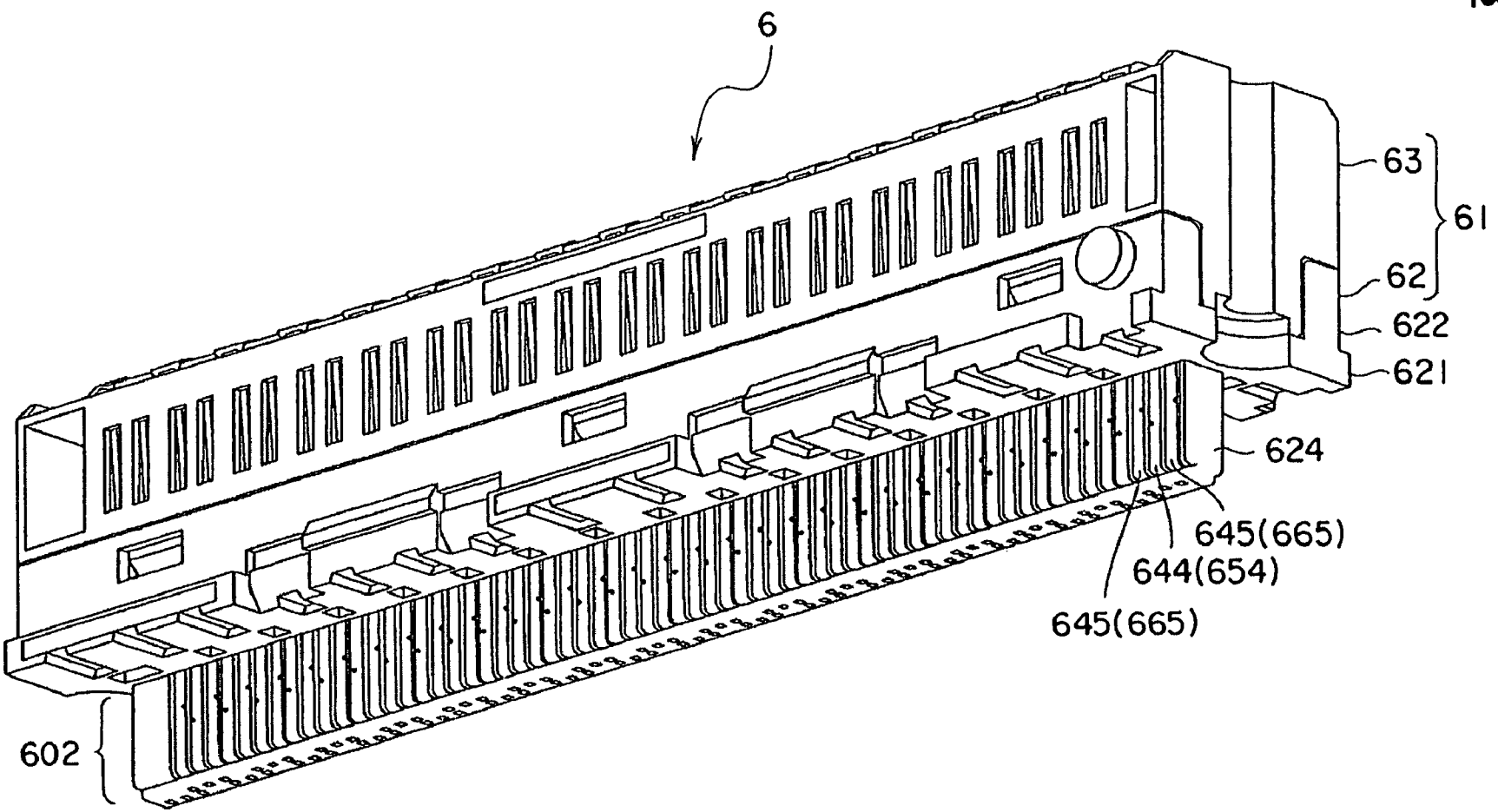
FIG. 8 is a perspective view from the bottom surface direction of a receptacle according to an embodiment of the present invention.

FIG. 8 is a perspective view of the receptacles 6 in the present embodiment as seen from below. As shown in the drawing, the housing 61 of the receptacle (intermediate connector) 6 comprises a lower housing 62 and an upper housing 63. The receptacle 6 can receive either a coaxial cable plug to which the coaxial cable is connected or a single-wire plug to which three single wires are connected.

The contacts of the receptacle 6 are held by being press-fit in the lower housing 62. Further, the upper housing 63 is provided with engagement recesses 601 for receiving coaxial cable plugs (coaxial connectors) 81 or single-wire plugs (single-wire connectors) 82.

Figure 9:
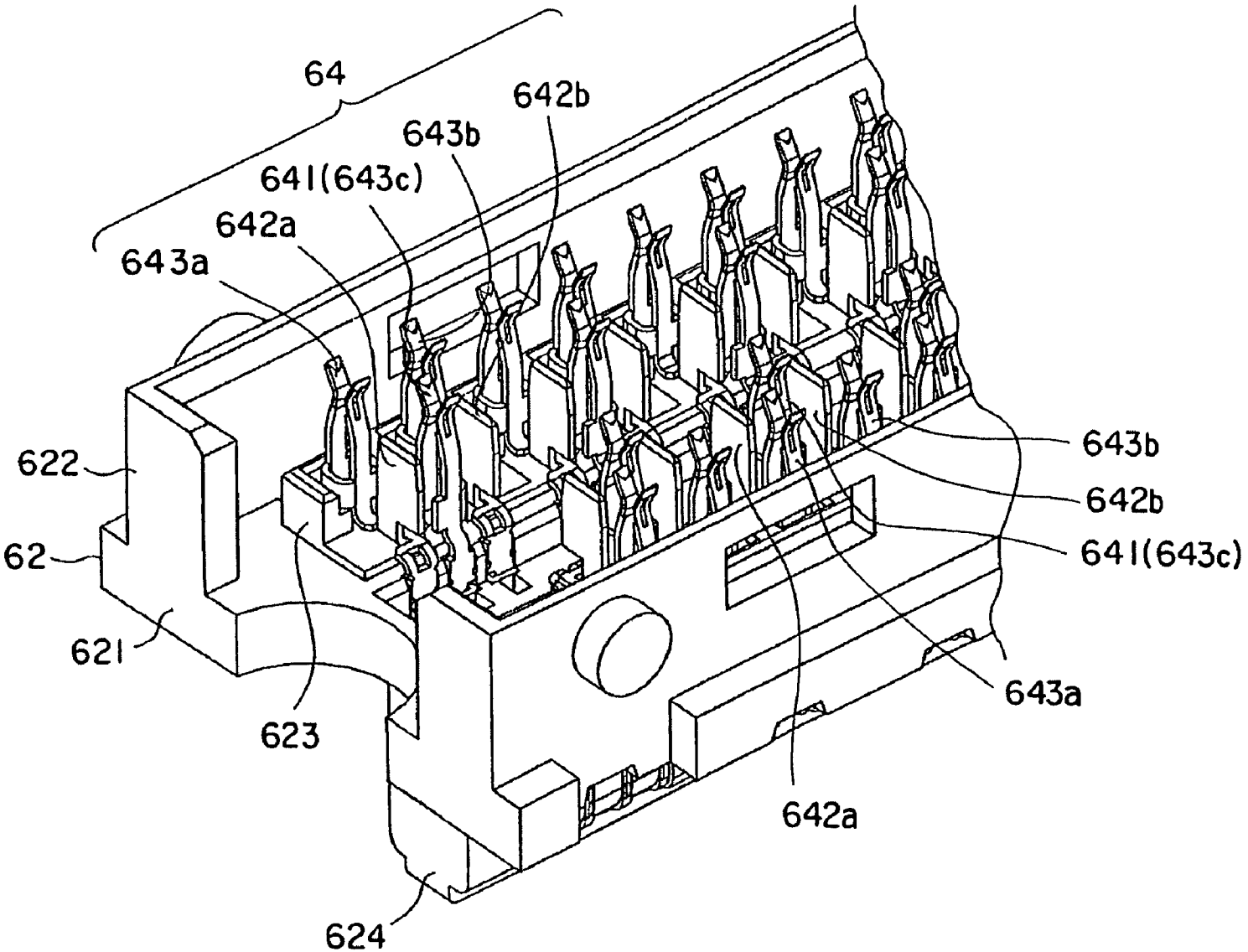
FIG. 9 is a partial perspective view showing a lower housing of a receptacle according to an embodiment of the present invention.
Figure 10:
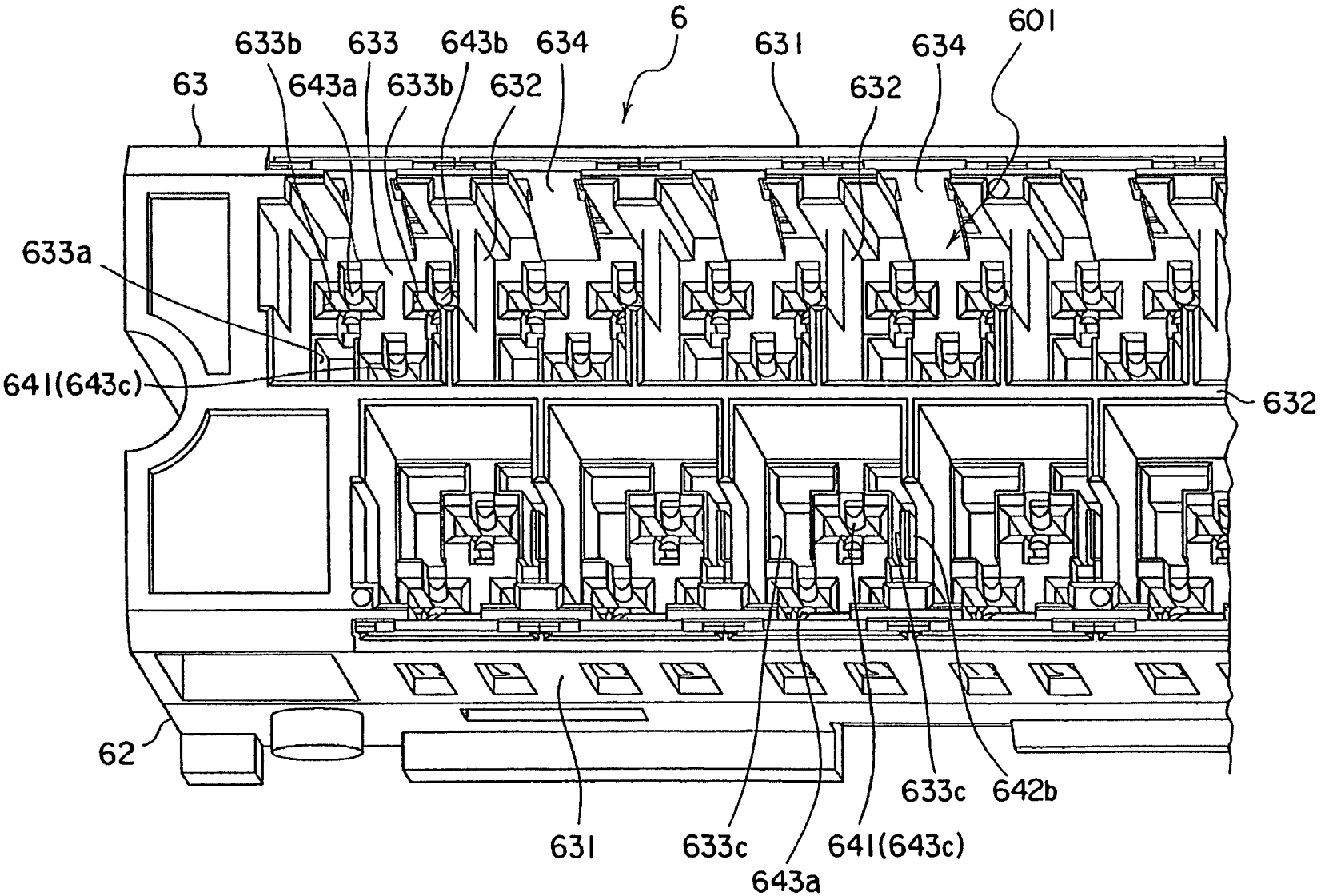
FIG. 10 is a partial perspective view from the planar direction of a receptacle according to an embodiment of the present invention.

FIG. 9 is a partial perspective view showing the inside of the lower housing 62, while FIG. 10 is a partial perspective view of the receptacle 6 seen from the engagement face side.

As shown in FIG. 8 and FIG. 9, the lower housing 62 is provided with a bottom floor 621 and a side wall 622 provided standing from the periphery of the bottom floor 62 and has a box-like shape with the surface facing the bottom floor 621 open. Further, below the bottom floor 621 of the lower housing 62, a block shaped external connection contact holder 624 is formed along the longitudinal direction of the bottom floor 621.

The lower housing 62 holds contacts forming contact units 64. This "contact unit 64" means a unit of a set of a plurality of contacts required for engagement with either a coaxial cable plug or a single-wire plug. One contact unit 64 comprises a total of five contacts of a first signal contact 641 (643*c*), ground contacts 642*a*, 642*b*, and second signal contacts 643*a*, 643*b*. Here, while explained in detail later, the first signal contact 641 (643*c*) is formed by one contact member 65. Further, the ground contact 642*a* and the second signal contact 643*a*, and the ground contact 642*b* and the second signal contact 643*b* are formed by integral contact members 66 and are shaped identically. Therefore, the five contacts consist of three contact members. These five contacts are surrounded by a partition wall 623 providing standing from the bottom floor 621 to a predetermined height. This contact unit 64, as explained later, can engage with either a coaxial cable plug 81 or a single-wire plug 82. The coaxial cable plug 81 is electrically connected to the first signal contact 641 and the ground contacts 642*a*, 642*b*. Further, the single-wire plug 82 is electrically connected to the first signal contact 643*c* and the second signal contacts 643*a*, 643*b*.

Figure 11:
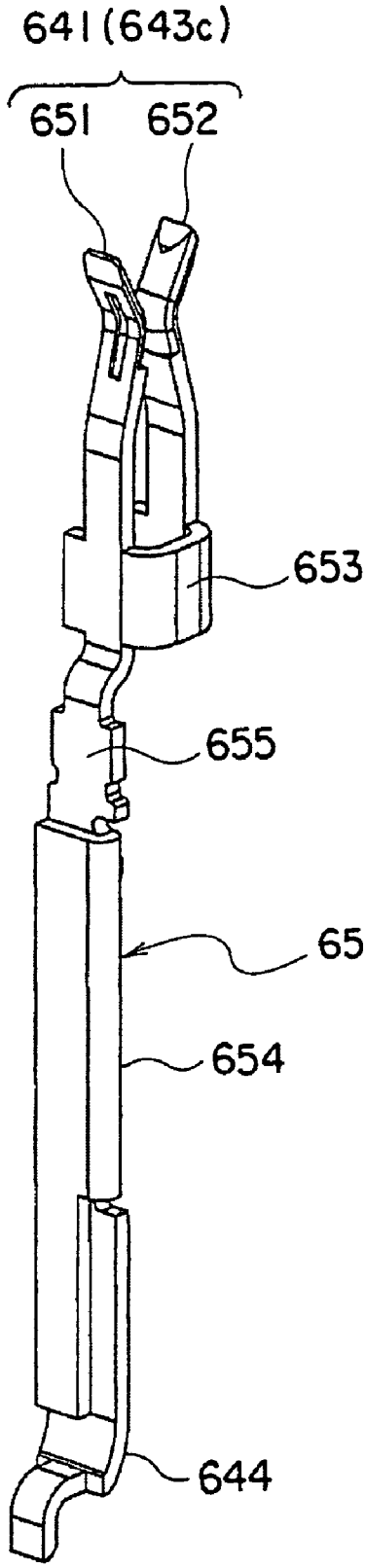
FIG. 11 is a perspective view showing a contact member used for a receptacle according to the embodiment of the present invention.

FIG. 11 is a perspective view of a first contact member 65 forming the first signal contact 641 (643*c*). The first contact member 65 is formed integrally by stamping and bending a metal sheet.

The first contact member 65 is provided at one end with a pair of resilient contact arms 651, 652 forming a first signal contact 641 (643*c*). The resilient contact arms 651, 652 are connected with each other by a U-shaped connecting part 653 at their base parts. The resilient contact arms 651, 652 have parts bent toward each other and form a clip type contact. By inserting an opposing side contact between the resilient contact arms 651, 652, the first signal contacts 641 (643*c*) and the opposing side contact are electrically connected. This opposing side contact is a signal contact of the later explained coaxial cable plug 81 or a signal contact of the later explained single-wire plug 82.

An extension part 654 is formed from the connecting part 653 to the other end of the first contact member 65. The extension part 654 passes through the bottom floor 621 of the lower housing 62. Therefore, the bottom floor 621 is formed with a through hole through which the extension part 654 passes. A press-fitting part 655 is formed between the connecting part 653 and the extension part 654. This press-fitting part 655 is press-fit in this through hole. The extension part 654 passing through the bottom floor 621 is arranged along the external connection contact holder 624. A part of the extention part 654 forms an external connection contact 644.

Figure 12:
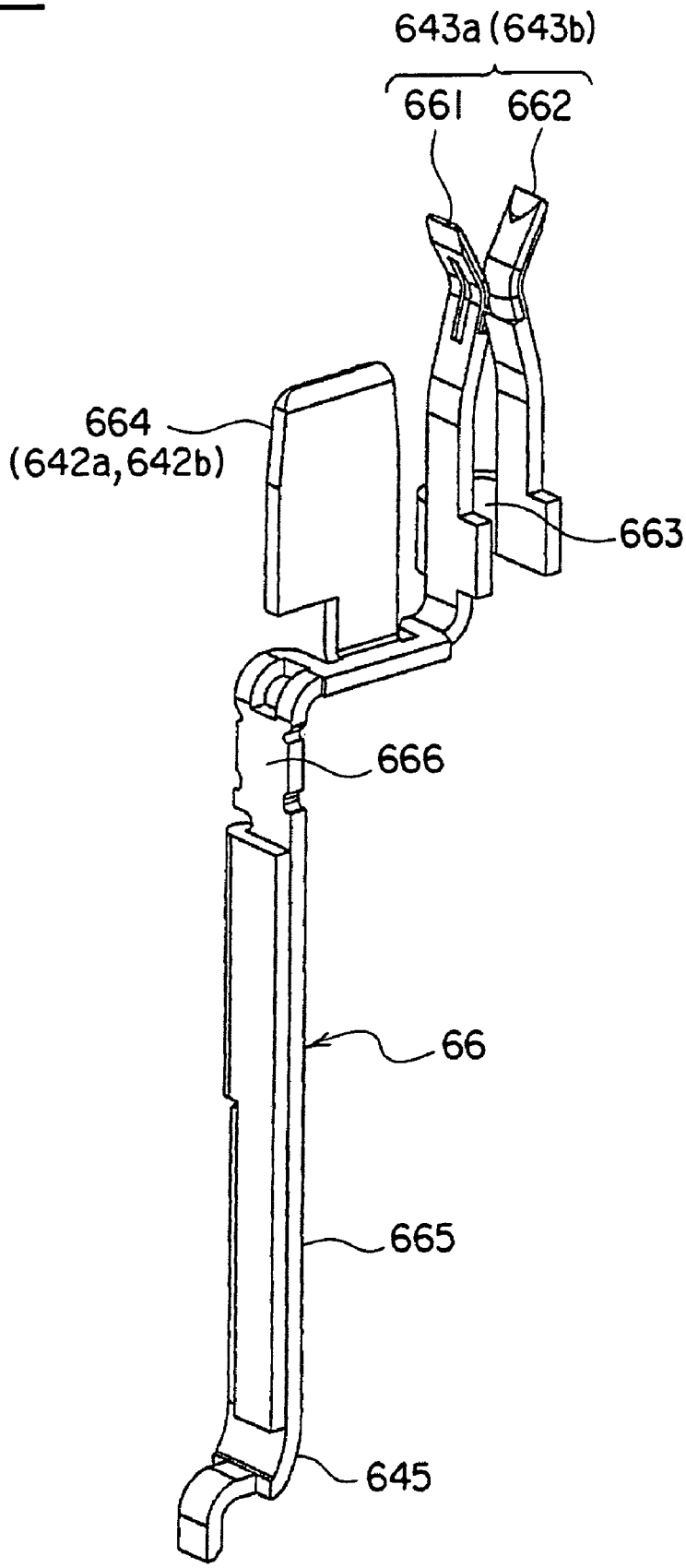
FIG. 12 is a perspective view showing a contact member used for a receptacle according to the embodiment of the present invention.

FIG. 12 is a perspective view of a second contact member 66 forming the ground contact 642*a* (642*b*) and the second signal contact 643*a* (643*b*). The second contact member 66 is also integrally formed by stamping and bending a metal sheet.

The second contact member 66 is provided at one end with a pair of resilient contact arms 661, 662 forming a second signal contact 643*a* (643*b*). The resilient contact arms 661, 662 are connected with each other by a U-shaped connecting part 663 at their base parts. The resilient contact arms 661, 662 have parts bent toward each other and form a clip type contact. By inserting an opposing side contact between the resilient contact arms 661, 662, the second signal contact 643*a* (643*b*) and the opposing side contact are electrically connected. This opposing side contact is a signal contact of the later explained single-wire plug 82. Note that the second signal contact 643*a* (643*b*) is shaped the same as the first signal contact 641 (643*c*). This corresponds to the same shapes of the three signal contacts of a single-wire plug 82.

The second contact member 66 is provided with a plate-shaped member 664. The plate-shaped member 664 forms a ground contact 642*a* (642*b*) in the state with the second contact member 66 held at the lower housing 62. The plate-shaped member 664 has the opposing side contact electrically connected to it. This opposing side contact is the ground contact 812 or the ground contact 813 of the later explained coaxial plug 81.

As shown in FIG. 12, the resilient contact arms 661, 662 and the plate-shaped member 664 are integrally formed. Therefore, the second signal contact 643*a* (643*b*) and the ground contact 642*a* (642*b*) are electrically connected with each other in the receptacle 6.

An extension part 665 is formed from the plate-shaped member 664 to the other end of the second contact member 66. The extension part 665 passes through the bottom floor 621 of the lower housing 62. Therefore, the bottom floor 621 is formed with a through hole through which the extension part 665 passes. A press-fitting part 666 is formed between the connecting part 663 and the extension part 665. This press-fitting part 666 is press-fit into this through hole. The extension part 665 passing through the bottom floor 621 is arranged along the external connection contact holder 624. A part of the extention part 665 forms the external connection contact 645.

As clear from FIG. 9, FIG. 11, and FIG. 12, the contact unit 64 consists of one first contact member 65 and two second contact members 66. In this way, the contact unit 64 is configured by two types of contact members, so the number of parts composing of the receptacle 6 can be reduced. Therefore, contacts can be arranged in a high density in the contact unit 64 and the receptacle 6 as a whole can be configured compactly. Further, reducing the number of parts also contributes to reduction of the costs.

Extension parts 654 of the first contact members 65 and extension parts 665 of the second contact members 66 respectively pass through the bottom floor 621 of the lower housing 62 and are arranged along the external connection contact holder 624. As shown in FIG. 8, the extension parts 654 of the first contact members 65 form first external connection contacts 644. Further, the extension parts 665 of the second contact members 66 form second external connection contacts 645. Each contact unit 64 comprises one first external connection contact 644 and two second external connection contacts 645. Further, each first external connection contact 644 is arranged at the center, while two second external connection contacts 645 are arranged at the both sides of the first external connection contact 644. These external connection contacts 644, 645, and 645 form output terminals 602 engaging with the engagement holes 42 of the test head side connector 41. Three external connection contacts corresponding to the five (total six) contacts are sufficient, so the receptacles 6 are formed compactly in that longitudinal direction.

In FIG. 9, the first signal contacts 641 (643*c*) are arranged so that the clip type contact parts open and close in the width direction of the housing 61. The same is true for the second signal contacts 643*a*, 643*b*. If the clip type contact parts are configured to open and close in the longitudinal direction of the lower housing 62, the dimension of the lower housing 62 in the longitudinal direction must be made larger. Therefore, the receptacles 6 are arranged with the clip type contact parts opening and closing in the width direction of the housing 61 so as to reduce the dimension in the longitudinal direction. This is due to consideration of the fact that much more space is required in the state with the clip type contact parts open.

The ground contacts 642*a*, 642*b* are arranged in parallel with each other. Further, the ground contacts 642*a*, 642*b* are arranged so that their flat surfaces are parallel with the width direction of the housing 61. At the center between the ground contacts 642*a* and the ground contacts 642*b*, the first signal contacts 641 are arranged.

As shown in FIG. 10, the upper housing 63 is provided with a side wall 631 surrounding it and forms a substantially box shape. The upper housing 63 is formed with a plurality of partition walls 632 in that longitudinal direction and width direction. A coaxial cable plug 81 or a single-wire plug 82 is guided by the partition walls 632 to the engagement position and prevented from leaning. Further, by being surrounded by the side wall 631 and the partition walls 632, the upper housing 63 is provided with a plurality of engagement recesses 601 consisting of cuboid-shaped spaces. The engagement recesses 601, that is, the contact units 64, are arranged in a zigzag configuration in the upper housing 63. One engagement recess 601 corresponds to one contact unit 64. The engagement recesses 601 have the later explained coaxial cable plugs 81 or single-wire plugs 82 inserted into them for engagement.

The upper housing 63 is provided with a bottom floor 633. The bottom floor 633 is divided into said cuboid-shaped spaces and the lower housing 62. The bottom floor 633 is formed with through holes 633*a* to 633*c*.

Through holes 633*a* correspond to a first signal contact 641 (643*c*). The top end of the first signal contact 641 (643*c*) is positioned in the through hole 633*a*. A signal contact 811 of a coaxial cable plug 81 (see FIG. 14) passes through the through hole 633*a* and is electrically connected with the first signal contact 641 of the receptacle 6. Alternatively, a signal contact 823 of a single-wire plug 82 (see FIG. 16) passes through the through holes 633*a* and is electrically connected to the first signal contact 643*c* (641) of the receptacle 6.

The through holes 633*b* correspond to the second signal contacts 643*a*, 643*b*. Therefore, two through holes 633*b* are formed in each engagement recess 601. The top ends of the second signal contacts 643*a*, 643*b* are positioned in the through holes 633*b*. The signal contacts 821, 822 of a single-wire plug 82 pass through the through holes 633*b* and are electrically connected to the second signal contacts 643*a*, 643*b* of the receptacle 6.

The through holes 633*c* correspond to the ground contacts 642*a*, 642*b*. Therefore, two through holes 633*c* are also formed in each engagement recess 601. The top ends of the ground contacts 642*a*, 642*b* are positioned in the through holes 633*c*. The ground contacts 812, 813 of a coaxial cable plug 81 pass through the through holes 633*c* and are electrically connected to the ground contacts 642*a*, 642*b* of the receptacle 6.

The side wall 631 of the upper housing 63 is formed with engagement tabs 634 running toward the insides of the engagement recesses 601. The engagement tabs 634, as explained later, make the engagement of the coaxial cable plugs 81 or the single-wire plugs 82 more reliable.

Figure 13:
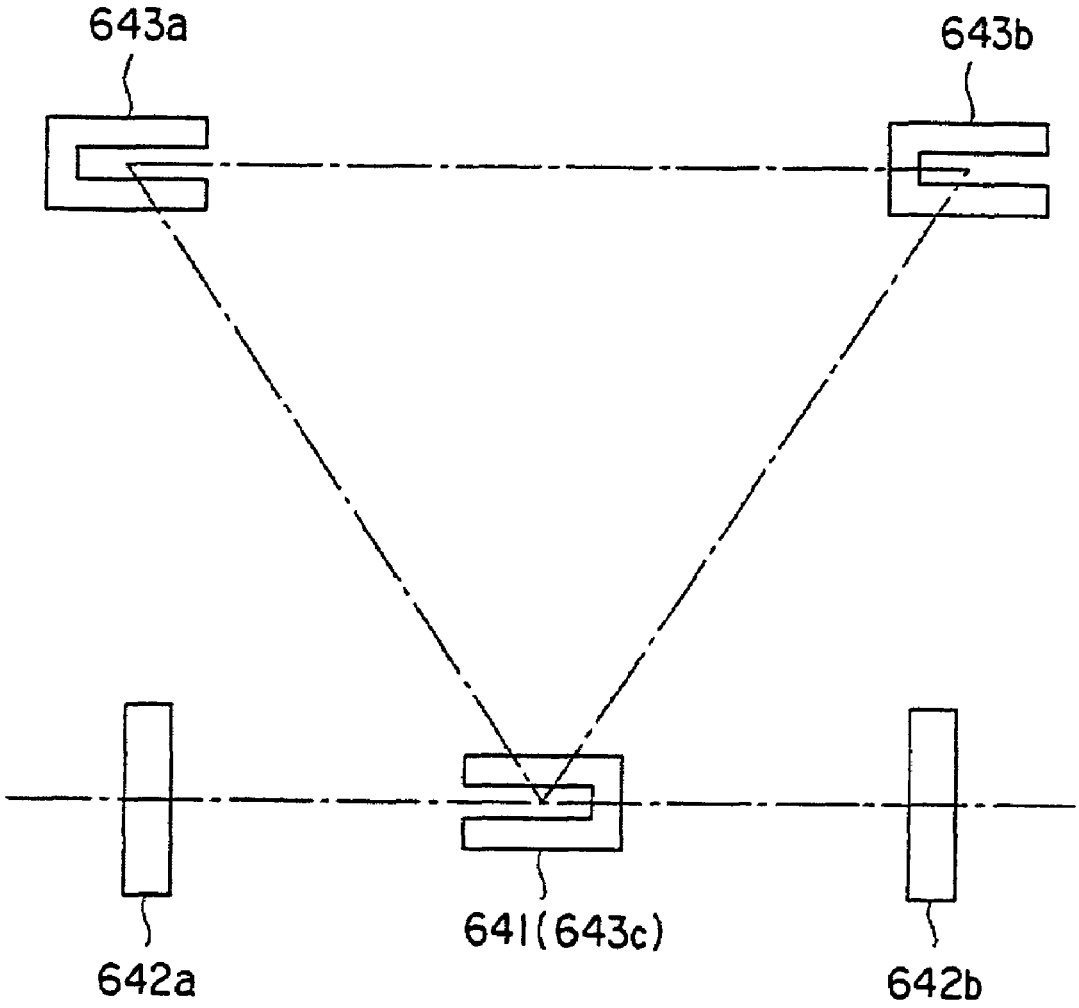
FIG. 13 is a view showing the arrangement of contacts of a receptacle according to the embodiment of the present invention.

FIG. 13 is a view schematically showing the arrangement of the first signal contact 641 (643*c*), the ground contacts 642*a*, 642*b*, and the second signal contacts 643*a*, 643*b* forming one contact unit 64. This arrangement is seen from the engagement face side of the receptacle 6.

As shown in FIG. 13, the ground contacts 642*a*, 642*b* are arranged at symmetric positions with respect to the first signal contact 641. Therefore, the first signal contact 641 (643*c*) and ground contacts 642*a*, 642*b* arrange on a line. The first signal contact 641 and the ground contacts 642*a*, 642*b* form a first group of contacts electrically connected to a coaxial cable plug 81.

The first signal contact 643*c* (641) and the second signal contacts 643*a*, 643*b* form a second group of contacts electrically connected to a single-wire plug 82. In the second group of contacts, the second signal contacts 643*a*, 643*b* are positioned at two points which are in an equal distance from the first signal contact 643*c*. Therefore, if connecting the centers of the first signal contact 643*c* and the second signal contacts 643*a*, 643*b*, an isosceles triangle is drawn. This "isosceles triangle" includes an equilateral triangle.

Further, in FIG. 13, the second signal contacts 643*a*, 643*b* of the second group of contacts are arranged at one side of the imaginary line connecting the first signal contact 641 and the ground contacts 642*a*, 642*b* of the first group of contacts. This requirement excludes the case where the second signal contacts 643*a*, 643*b* are aligned with the first signal contact 641 and the ground contacts 642*a*, 642*b*. If all contacts are aligned, the direction of arrangement becomes too long. Further, this requirement excludes the case where the second signal contacts 643*a*, 643*b* are arranged sandwiching the imaginary line connecting the first signal contact 641 and the ground contacts 642*a*, 642*b*. The ground contact 642*a* and the second signal contact 643*a*, and further the ground contact 642*b* and the second signal contact 643*b* are respectively formed by integral contact members 66, so the elements cannot be arranged in the above way.

A receptacle 6 having a first signal contact 641 (643*c*) the ground contacts 642*a*, 642*b*, and the second signal contacts 643*a*, 643*b* arranged in the above way can receive either a coaxial cable plug 81 or a single-wire plug 82.

Next, as shown in FIG. 13, one contact unit 64 has the imaginary line connecting the ground contacts 642*a*, 642*b* and the imaginary line connecting the second signal contacts 643*a*, 643*b* parallel with each other. Further, the ground contacts 642*a*, 642*b* and the second signal contacts 643*a*, 643*b* are at vertexes of a rectangle. That is, the contact unit 64 has five contacts arranged at a high density in a rectangular area.

Each receptacle 6 has the first group of contacts and the second group of contacts sharing the first signal contact 641 (643*c*). Of course, the first signal contact 641 and the first signal contact 643*c* may be separately provided. However, in such a way, the area occupied by the first signal contact 641 and the first signal contact 643*c* increases and the engagement recess ends up becoming larger compared with one contact unit. Therefore, the receptacle 6 combines the first signal contact 641 and the first signal contact 643*c*, so enables the contacts to be arranged with a higher density. Further, this sharing contributes to the reduction of the number of parts of the receptacle 6 and enables the external connection contacts to be combined into one.

The electrical cables 7 in the present embodiment include coaxial cables 71 for transmitting high speed signals and single wires 72 for supplying power or transmitting low speed signals.

Figure 14:
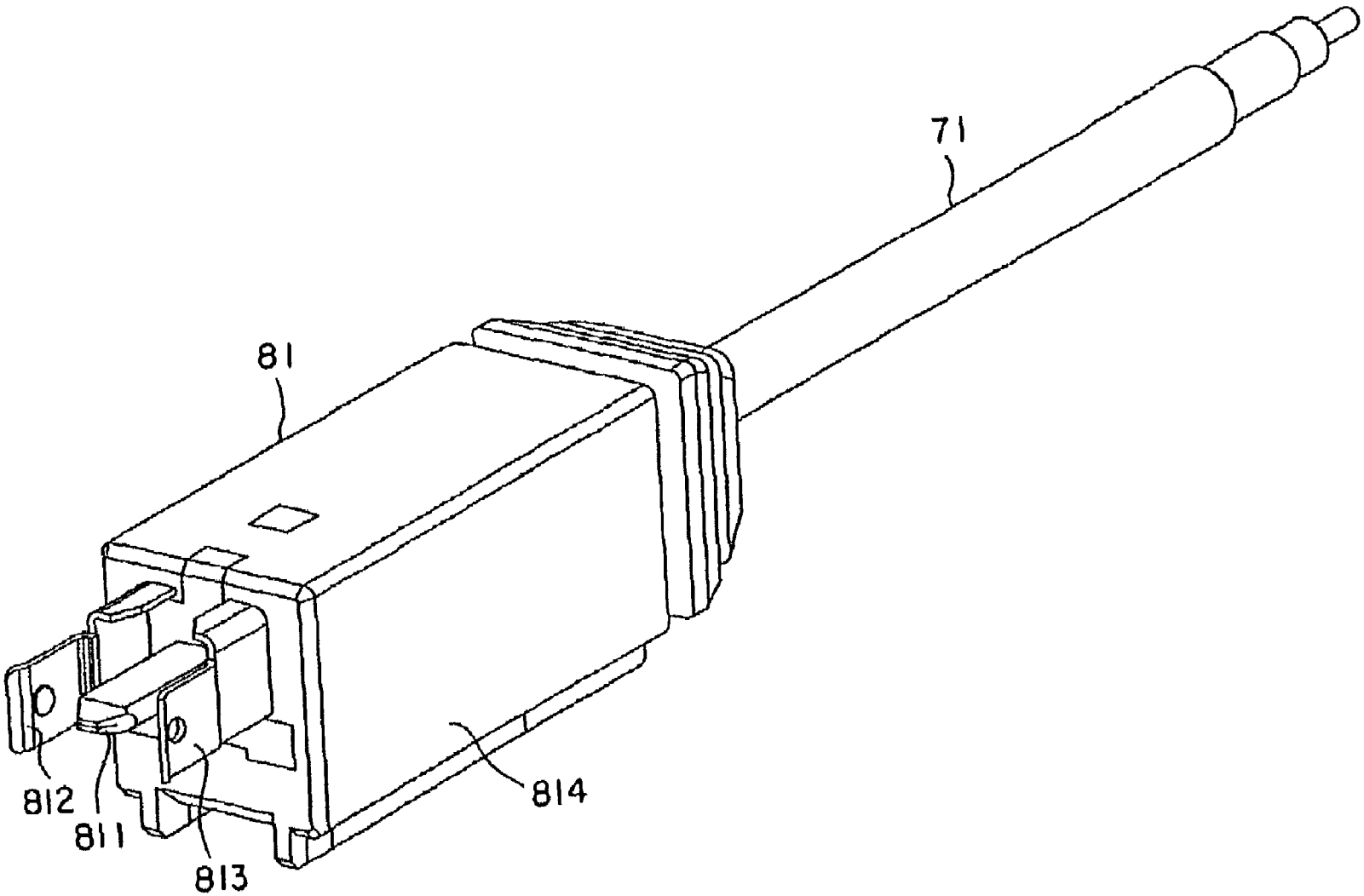
FIG. 14 is a perspective view showing a coaxial cable plug to be engaged with a receptacle according to the embodiment of the present invention.

FIG. 14 is a perspective view showing the appearance of a coaxial cable plug 81. Further, FIG. 15 is a perspective view showing the principal parts of the coaxial cable plug 81.

Figure 15:
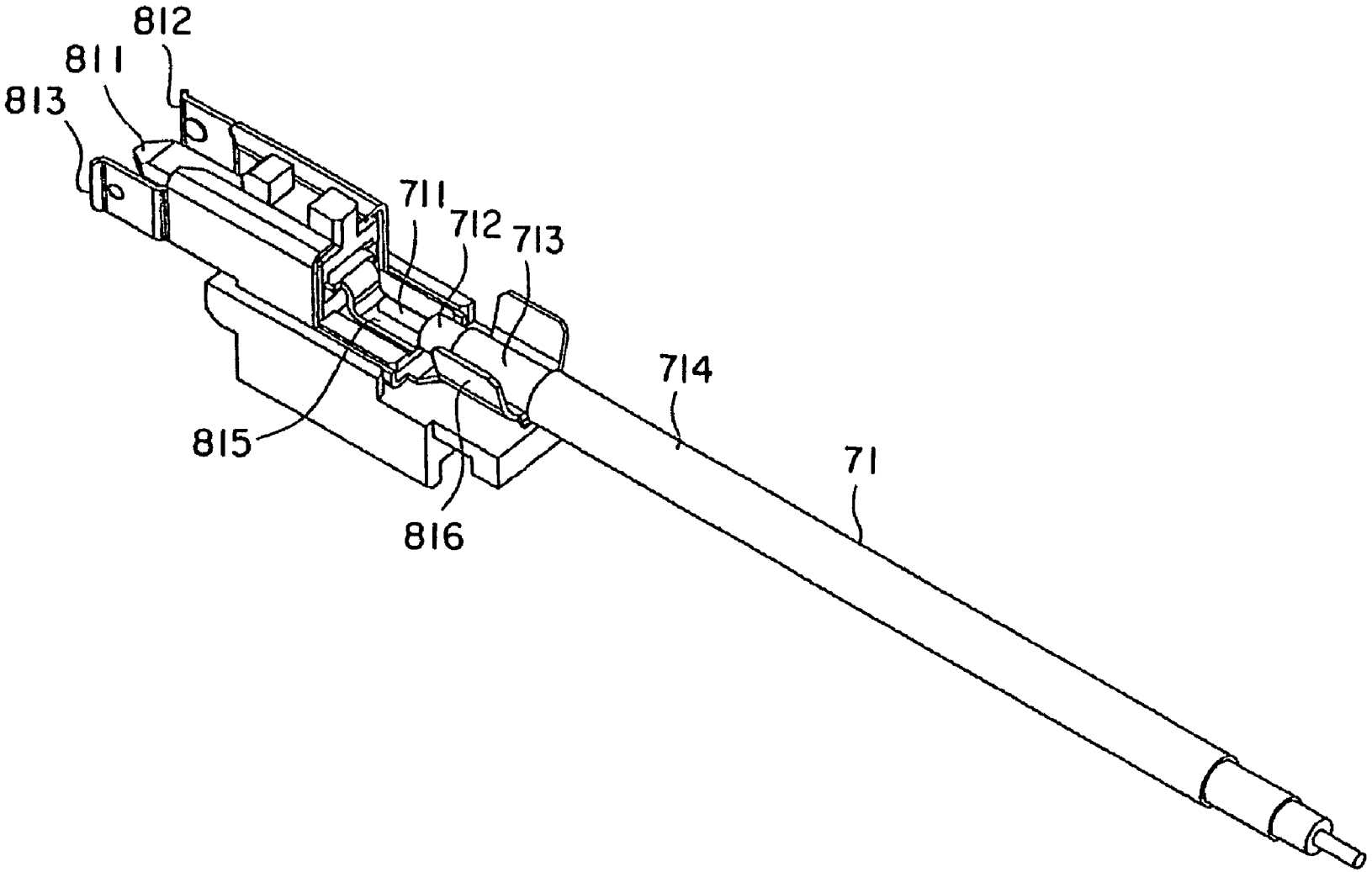
FIG. 15 is a perspective view showing principal parts of the coaxial cable plug shown in FIG. 14.

As shown in FIG. 14 and FIG. 15, the coaxial cable plug 81 is attached to a coaxial cable 71. The coaxial cable 71, as is well known, comprises a center conductor 711; a dielectric 712 surrounding the center conductor 711; an outer conductor 713 surrounding the dielectric 712; and an insulation covering 714 surrounding the outer conductor 713.

The coaxial cable plug 81 is provided with a signal contact 811 and a pair of ground contacts 812, 813. The positional relationship of the signal contact 811 and the pair of ground contacts 812, 813 is similar to that of the first group of contacts of the receptacle 6. That is, the ground contacts 812, 813 are positioned symmetrically with respect to the signal contact 811. Further, the ground contacts 812, 813 formed by plate shaped members are arranged so as to have flat surfaces parallel to each other. Making the ground contacts 812, 813 plate-shaped members in this way and sandwiching the signal contacts 811 is intended to make the coaxial cable plug 81 electrically equivalent to the coaxial structure so as to make the characteristic impedance match with the coaxial cable 71 as much as possible. The receptacle 6 also has the ground contacts 642*a*, 642*b* made plate-shaped members corresponding to the ground contacts 812, 813.

The signal contact 811 and the pair of ground contacts 812, 813 are held in a housing 814 made of an insulating material. The inside of the housing 814 is provided with a space for receiving the signal contact 811 and other members. Inside the housing 814, these contacts are secured electrical connection with the coaxial cable 71. The signal contact 811 is electrically connected with the center conductor 711 of the coaxial cable 71 through the center conductor connection piece 815 electrically connected with the signal contact 811. Further, the ground contacts 812, 813 are electrically connected to the outer conductor 713 of the coaxial cable 71 through the outer conductor connection piece 816 electrically connected with the ground contacts 812, 813. The outer conductor connection piece 816 abuts against the wall separating the space inside the housing 714 at the bottom and top in the figure, whereby even if the coaxial cable 71 is twisted, a change in the relative positions of the signal contact 811 and the ground contacts 812, 813 following this is prevented.

The coaxial cable plug 81 is structured with the outer conductor 713 split into the two ground contacts 812, 813. Further, the split two ground contacts 642*a*, 642*b* of the receptacle 6 are sometimes combined into one electrical path outside of the receptacle 6 past the second external connection contact 645. In this case, a ground loop are formed by that the ground contact 812 and the ground contact 642*a*, and the ground contact 813 and the ground contact 642*b* are electrically connected. The receptacle 6, as explained above, can have the contacts arranged in a high density in the contact unit 64, more specifically have the intervals between the ground contacts 642*a*, 642*b* reduced, so the noise due to the ground loop can be reduced.

Figure 16:
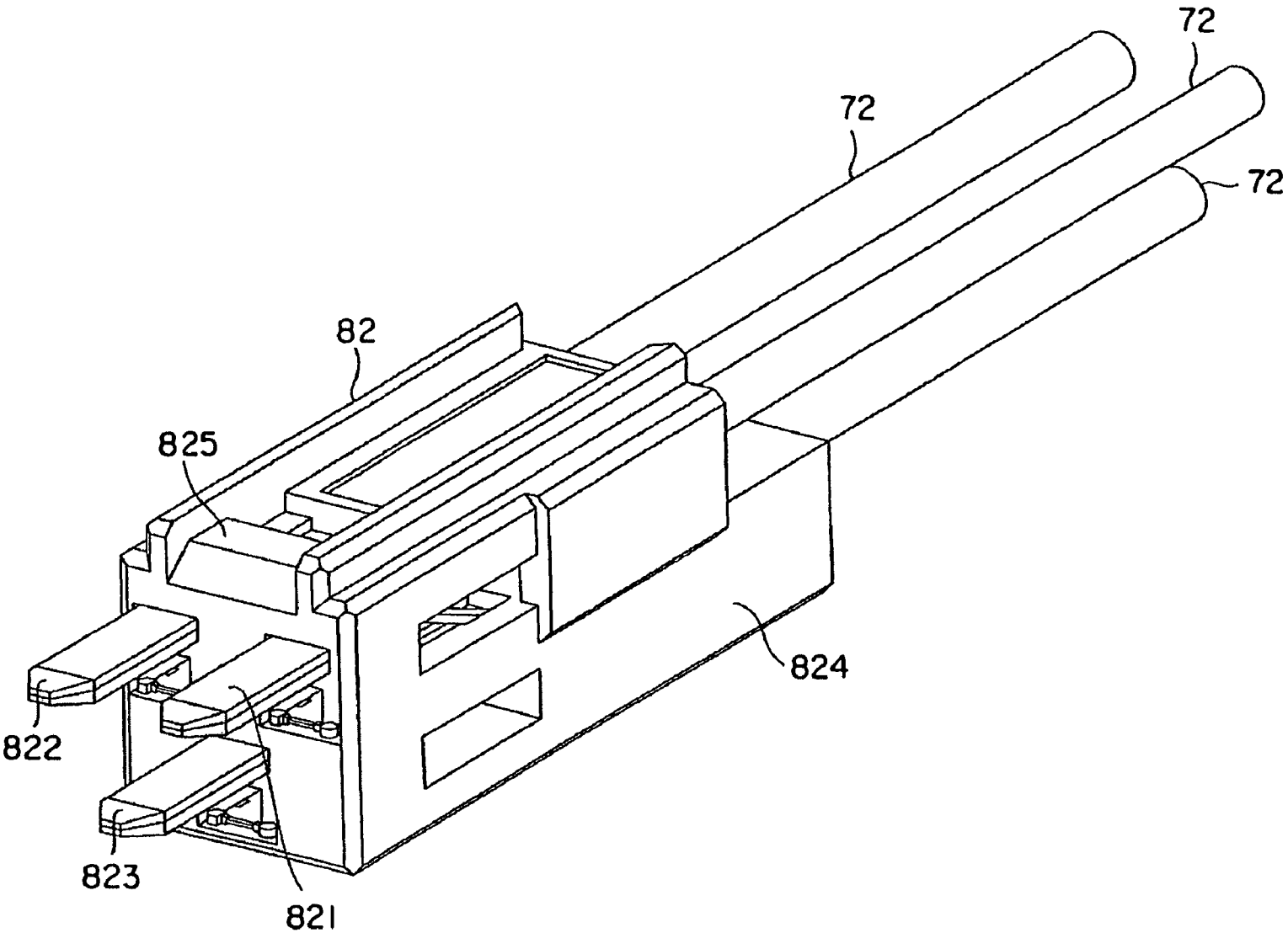
FIG. 16 is a perspective view showing a single-wire plug to be engaged with a receptacle according to the embodiment of the present invention.
Figure 17:
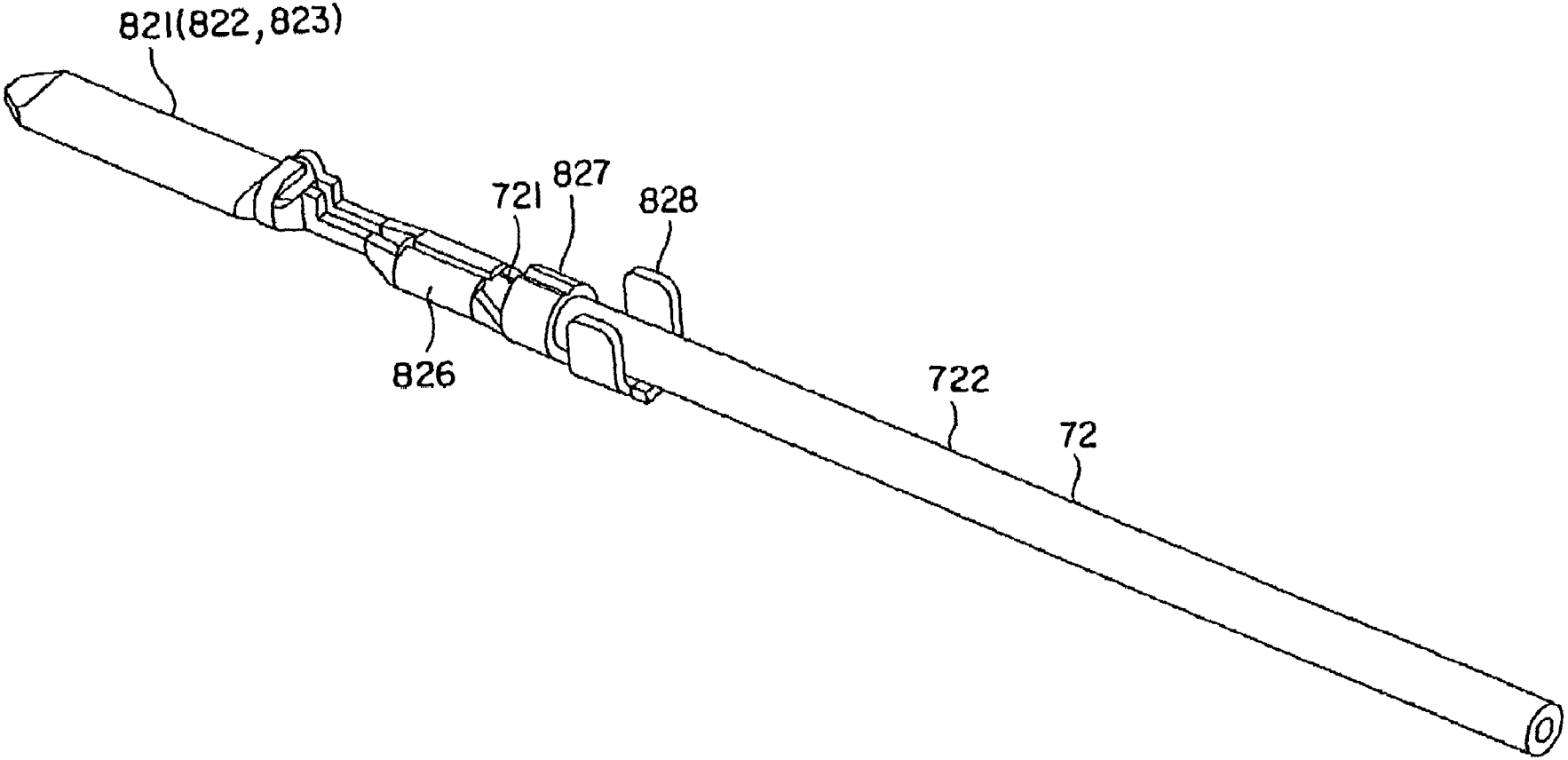
FIG. 17 is a perspective view showing principal parts of the single-wire plug shown in FIG. 16.

Next, FIG. 16 is a perspective view showing the appearance of a single-wire plug 82. Further, FIG. 17 is a perspective view showing principal parts of the single-wire plug 82.

As shown in FIG. 16, the single-wire plug 82 is attached to three single wires 72. The single wire 72 (an electrical wire), as is well known, comprises a signal conductor 721 and an insulator 722 surrounding the signal conductor 721. The single-wire plug 82 is provided with three signal contacts 821 to 823. The positional relationship between the three signal contacts 821 to 823 is similar to that of the second group of contacts of the receptacle 6. That is, the signal contacts 821, 822 are positioned at two points which are in an equal distance from the signal contact 823. Therefore, if connecting the centers of the signal contacts 821 to 823, an isosceles triangle is drawn when viewed from the engagement face.

The signal contacts 821 to 823 are held in a housing 824 made of an insulating material. The engagement part of the housing 824 has the same external shape as the engagement part of the housing 814 of the coaxial cable plug 81 so that the receptacle 6 receives either a coaxial cable plug 81 or a single-wire plug 82. However, the "same" referred to here means similarity of an extent where a coaxial cable plug 81 and a single-wire plug 82 can be engaged. Complete physical similarity is not required.

Inside the housing 824, these contacts are secured electrical connection with single wires 72. The signal contact 821 (822, 823) is electrically connected with a signal conductor 721 of a single wire 72 through a conductor barrel 826 electrically connected with the signal contact 821 (822, 823). A U-shaped insulation barrel 827 with which the signal contact 821 and the conductor barrel 826 integrally formed are crimped around to the insulator 722 of the single wire 72, whereby the signal contact 821 and the single wire 72 are strongly bonded. Further, U-shaped stabilizer 828 formed integrally with the signal contact 821 etc. prevents the movement of the relative positions of the signal contacts 821 to 823 in the same way as the above-mentioned outer conductor connection pieces 816.

Further, the housing 824 is formed with an engagement projection 825 at its outer circumference. This engagement projection 825 is engaged with an engagement tab 634 of the upper housing 63 when the single-wire plug 82 engages with a receptacle 6, whereby the single-wire plug 82 is prevented from detachment from the receptacle 6. Note that while not shown, a coaxial cable plug 81 is also formed with an engagement projection in the same way as the single-wire plug 82.

Now, when engaging the coaxial cable plug 81 with a receptacle 6, the coaxial cable plug 81 is inserted into the engagement recess 601 formed by the upper housing 63 of the receptacle 6 from where the signal contact 811 and the pair of ground contacts 812, 813 are formed. Then, the first signal contact 641 of the receptacle 6 and the signal contact 811 of the coaxial cable plug 81 come into contact. Further, the ground contact 642*a* of the receptacle 6 and the ground contact 812 of the coaxial cable plug 81 come into contact and the ground contact 642*b* of the receptacle 6 and the ground contact 813 of the coaxial cable plug 81 come into contact.

On the other hand, when engaging a single-wire plug 82 in a receptacle 6, the single-wire plug 82 is inserted into the engagement recess 601 formed by the upper housing 63 of the receptacle 6 from where the signal contacts 821 to 823 are formed. Then, the first signal contact 643*c* of the receptacle 6 and the signal contact 823 of the single-wire plug 82 come in contact. Further, the second signal contact 643*a* of the receptacle 6 and the signal contact 821 of the single-wire plug 82 come into contact, and the second signal contact 643*b* of the receptacle 6 and the signal contact 822 of the single-wire plug 82 come into contact.

The above receptacle 6 is provided with the first group of contacts to be electrically connected to the coaxial cable plug 81 and the second group of contacts to be electrically connected to the single-wire plug 82 and therefore can receive either the coaxial cable plug 81 or the single-wire plug 82.

The coaxial cable plug 81 has the ground contacts 812, 813 positioned symmetrically with respect to the signal contact 811. On the other hand, the receptacle 6 has the ground contacts 642*a*, 642*b* arranged symmetrically with respect to the first signal contact 641. Further, the ground contacts 812, 813 and the ground contacts 642*a*, 642*b* are formed by plate members having predetermined surface areas. The above configuration contributes to matching of the characteristic impedances between the coaxial cable plug 81, the receptacle 6 and the coaxial cables 71.

The receptacle 6 has the first signal contact 641 and the first signal contact 643*c* formed by one first contact member 65 and has the ground contact 642*a* (642*b*) and the second signal contact 643*a* (643*b*) formed by one second contact member 66. In this way, the receptacle 6 can be formed by two types of contact members, so the number of parts for forming one contact unit 64 can be reduced. Therefore, the contacts forming the contact units 64 can be arranged at a high density and, when arranging a large number of contact units 64, the receptacle 6 as a whole can be made more compact.

Further, in the receptacle 6, the contact unit 64 is formed by one first contact member 65 and two contact members 66, so three external connection contacts are sufficient for one contact unit 64. This also contributes to greater compactness of the receptacle 6.

Further, the receptacle 6 has contacts arranged in the rectangular region of the contact unit 64. Therefore, engagement parts of the housings 814, 824 of the coaxial cable plug 81 and the single-wire plug 82 engaged with this contact unit 64 can be made rectangular in cross-sectional shapes and the same in outer shapes.

Further, the receptacle 6 has contact units 64 arranged in a zigzag shape, so the ground contacts and the signal contacts are arranged alternately. As a result, the effect of avoiding a drop in the high frequency characteristics is exerted.

Note that the engagement hole 601 of the intermediate connector (receptacle) 6 in the present embodiment corresponds to the first engagement part in the present invention, while the output terminal 602 of the intermediate connector 6 in the present embodiment corresponds to the second engagement part in the present invention.

As explained above, in the present embodiment, both a coaxial cable plug 81 and a single-wire plug 82 can be engaged with the first engagement part 601 of the intermediate connector 6, so one type of intermediate connector 6 can be used to handle a plurality of types of cables, so the HiFix 5A can be reduced in cost.

Further, by enabling both of a coaxial cable plug 81 and a single-wire plug 82 to be engaged with the first engagement part 601 of the intermediate connector 6, the load of the work for connecting the electrical cables 7 to the conventional interconnection board is remarkably reduced and the connection work with the interconnection board can be performed without having to differentiate between coaxial cables and single wires one by one.

Returning to FIG. 6, guide pins 603 projecting downward are provided at the bottom both ends of the housing 61 of the intermediate connectors 6. Further, guide holes 43 are formed so as to face the guide pins 603 at the top both ends of the test head side connectors 41 provided at the top of the test head 4. When mounting the HiFix 5A on the test head 4, the guide pins 603 are guided into the guide holes 43, whereby the HiFix 5A can be easily positioned with respect to the test head 4. Note that it is also possible to provide guide holes in the intermediate connectors 6 and provide guide pins in the test head side connectors 41.

Further, as shown in the drawing, the housing 61 of the intermediate connectors 6 is formed at its bottom both ends with through holes 604 passing through the housing 61 from the bottom surface toward the top surface. The frame 52 is formed with fastening holes 52*b* at positions corresponding to the through holes 604. By fastening bolts 605 into the fastening holes 52*b* through the through holes 604, it becomes possible to fasten the intermediate connectors 6 to the frame 52.

Returning to FIG. 4, a spacing frame 93 is provided at the top of the frame 52 fastening the plurality of intermediate connectors 6 through spacer posts 52*a* able to move up and down somewhat along the Z-axial direction.

At the top part of the spacing frame 93, sub socket boards 96 are provided through sub socket board spacers 95. Further, at the tops of the sub socket boards 96, socket boards 98 are provided through socket board spacers 97.

Further, the intermediate connectors 6 and the sub socket boards 96 are connected by a plurality of electrical cables 7. At the bottom ends of the electrical cables 7, device side connectors 8 are attached. The device side connectors 8 can be detachably connected to the engagement holes 601 of the intermediate connectors 6. On the other hand, the top ends of the electrical cables 7 are directly connected to the sub socket boards 96 by soldering.

Figure 18:
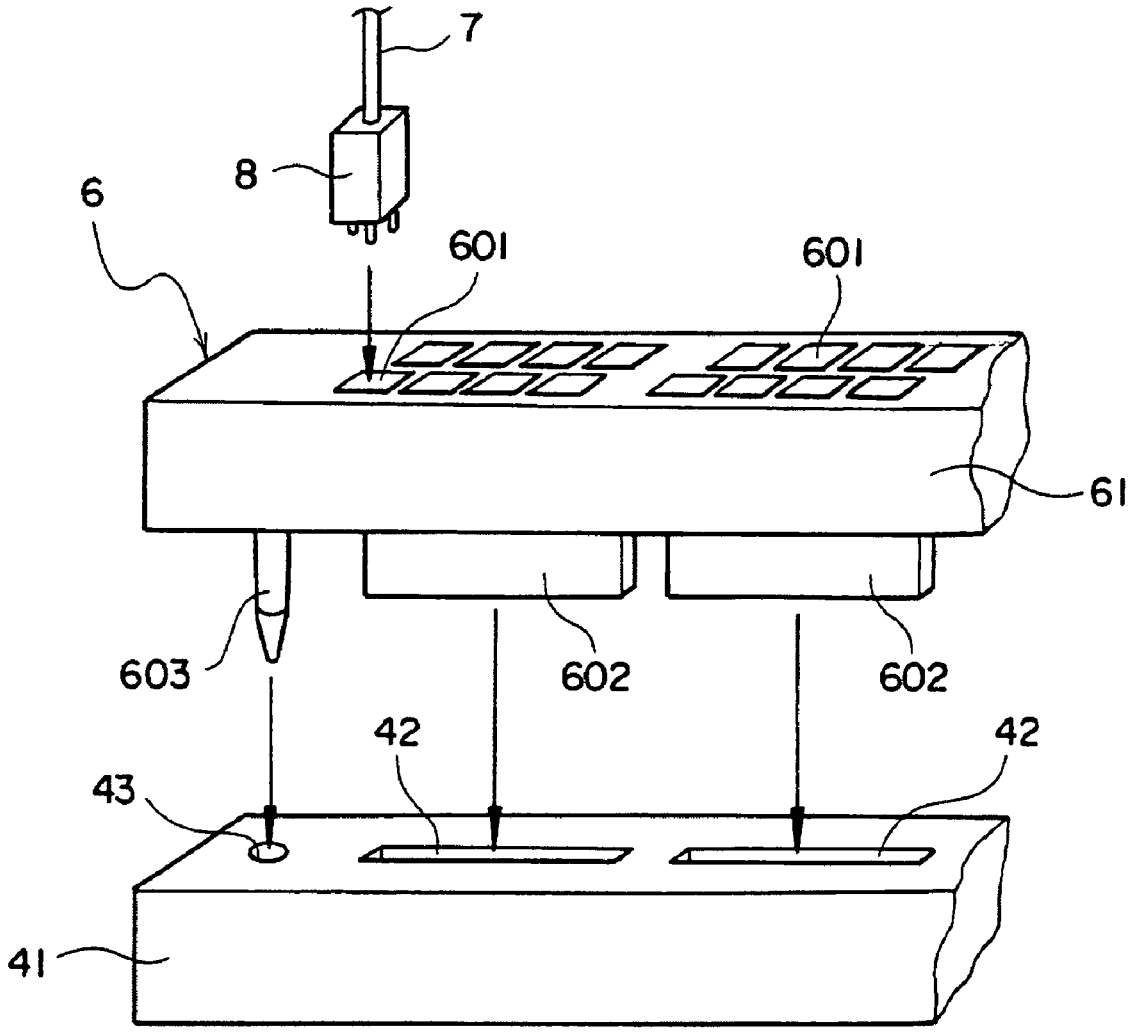
FIG. 18 is a partial perspective view of a device side connector, an intermediate connector, and a test head side connector in the first embodiment of the present invention.

FIG. 18 is a partial perspective view of a device side connector, a intermediate connector, and a test head side connector in the first embodiment of the present invention.

As shown in FIG. 18, when the device side connector 8 is engaged with the engagement hole 601 of the intermediate connector 6, the terminals of the device side connector 8 are electrically connected to the output terminal 602 of the intermediate connector 6. Further, when the output terminal 602 of the intermediate connector 6 is engaged with the engagement hole 42 of the test head side connector 41, the HiFix 5A and the test head 4 are electrically connected. Note that the test head side connector 41, while not particularly illustrated, is electrically connected to a pin electronics board held in the test head 4.

In the present embodiment, intermediate connectors 6 are employed instead of the conventional interconnection board, so the soldering work of the ends of the electrical cables 7 is eliminated and the HiFix 5A can be easily fabricated.

As shown in FIG. 4, the sub socket boards 96 are provided with intermediate terminals 961. The intermediate terminals 961 are used for electrical connection of the sub socket boards 96 and the socket boards 98.

Note that for convenience in explanation, FIG. 4 shows only two socket boards 98, but in actuality for example 64 socket boards 98 are arranged in a four-row 16-column array.

Each socket board 98 is provided on top with a socket 99 having a plurality of contact pins (not shown). That socket 99 is provided around it with a socket guide 991. Note that the socket guide 991 is a guide means for positioning an IC device under test when bringing the IC device into electrical contact with the contact pins of the socket 99 and may be omitted in some cases.

In the above first embodiment, the example of application of the present invention to the SBC type of HiFix was explained, but the invention is not particularly limited to this. The present invention can also be applied to the following various types of HiFixes.

Second Embodiment

Figure 19:
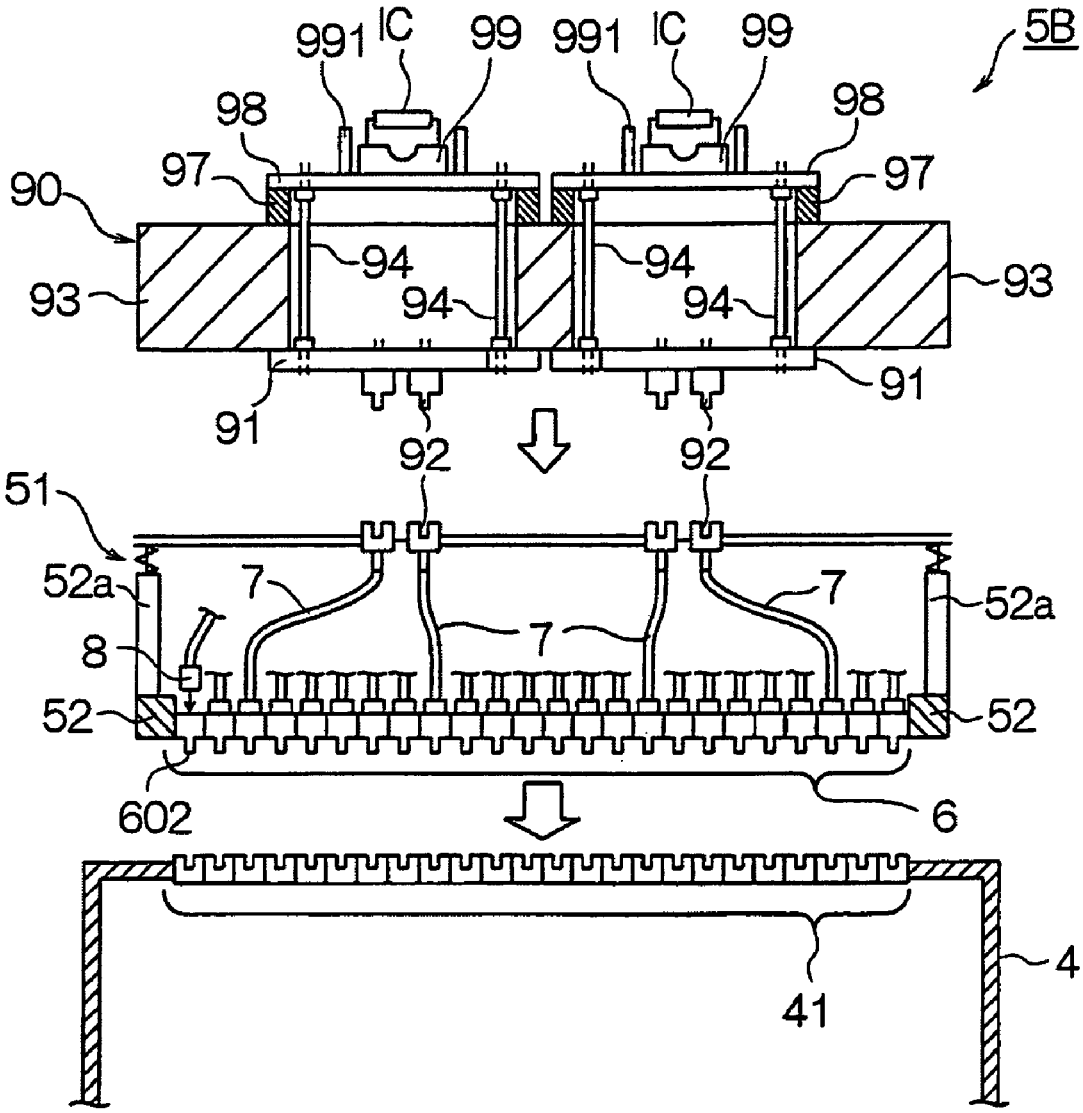
FIG. 19 is a cross-sectional view showing a HiFix and a test head according to a second embodiment of the present invention.

FIG. 19 is a cross-sectional view showing a HiFix and a test head according to a second embodiment of the present invention.

The HiFix 5B according to the present embodiment, as shown in FIG. 19, is a CLS (Cable Less) type of HiFix enabling a change in kind of IC devices under test to be handled by replacement of a topmost DSA (Device Specific Adapter) 90. This HiFix 5B, as shown in the drawing, comprises a mother board 51 mounted on the top of the test head 4 and a DSA 90 mounted to this mother board 51.

The HiFix 5B according to the present embodiment is configured integrally from the sockets 99 to the spacing frame 93 as the DSA 90. This differs from the HiFix 5A according to the first embodiment in the point that the DSA 90 can be attached to and detached from the mother board 51 by the connectors 92.

The DSA 90 is configured with the spacing frame 93 provided on top of performance boards 91 and further with socket boards 98 provided on top of them through socket board spacers 97. Sockets 99 are mounted on the socket boards 98.

The performance boards 91 and the socket boards 98 are connected by connect boards 94. Further, the performance boards 91 are provided with a plurality of pairs of connectors 92 for attachment to/detachment from the mother board 51. One of these connectors 92 is attached to one end of an electrical cable 7.

In the same way as first embodiment, a device side connector 8 is attached to the other end of the electrical cable 7. At the bottommost part of the HiFix 5B according to the present embodiment, a plurality of intermediate connectors 6 explained in detail of the first embodiment are provided in the state arranged substantially in parallel in the depth direction of the HiFix 5B. The device side connectors 8 are detachably connected to the engagement holes 601 of the intermediate connectors 6.

When the device side connector 8 is engaged with the engagement hole 601 of the intermediate connector 6, the terminals of the device side connector 8 are electrically connected to the output terminal 602 of the intermediate connector 6. Further, when the output terminal 602 of the intermediate connector 6 is engaged with the engagement hole 42 of the test head side connector 41, the HiFix 5B and the test head 4 are electrically connected.

Third Embodiment

Figure 20:
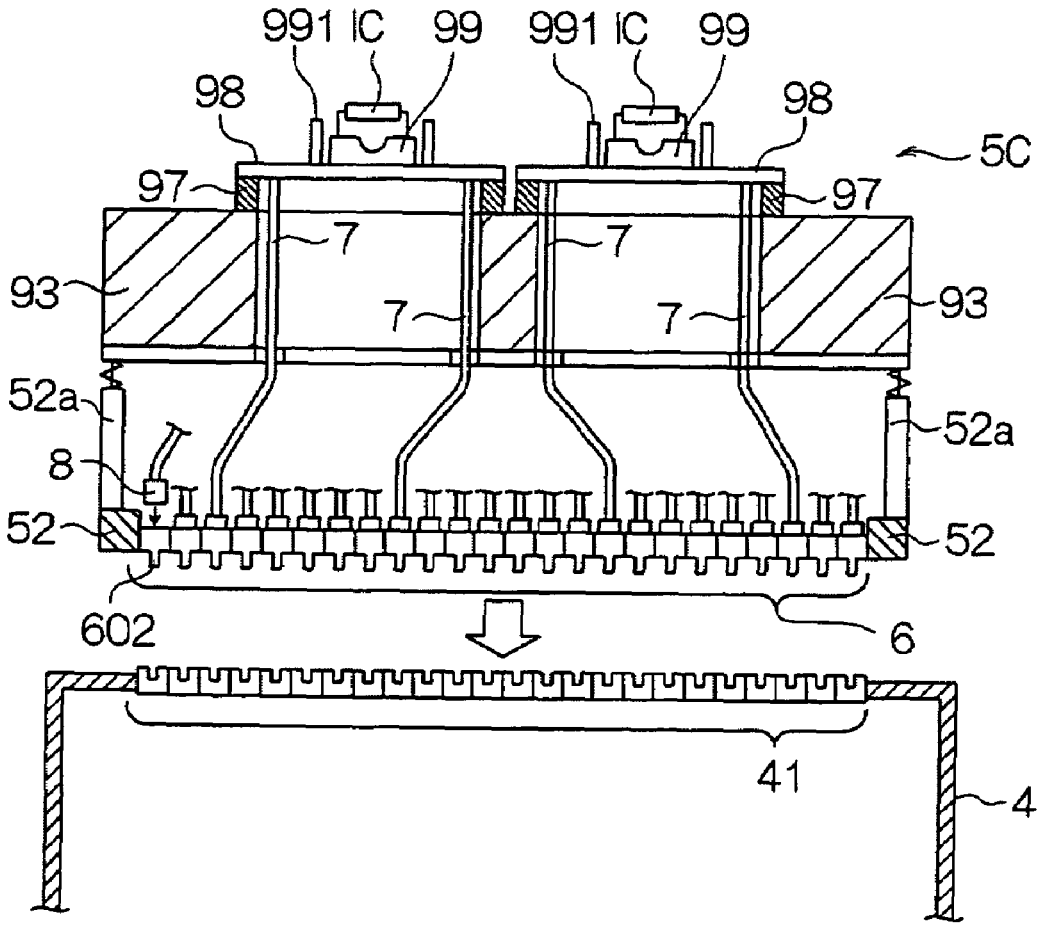
FIG. 20 is a cross-sectional view showing a HiFix and a test head according to a third embodiment of the present invention.

FIG. 20 is a cross-sectional view showing a HiFix and a test head according to a third embodiment of the present invention.

The HiFix 5C according to the present embodiment, as shown in FIG. 20, is a CCN (Cable Connection) type of a HiFix where the entire HiFix 5C is replaced each time changing the kind of the IC devices under test. This HiFix 5C differs from the HiFixes 5A, 5B according to the first embodiment and second embodiment in the point that there are no separable locations at the HiFix SC at all.

At the bottommost part of this HiFix 5C, a plurality of intermediate connectors 6 explained in the first embodiment are provided in the state arranged substantially in parallel along the depth direction of the HiFix SC. The device side connectors 8 attached to the ends of the electrical cables 7 are detachably connected to the engagement holes 601 of the intermediate connectors 6.

The other ends of the electrical cables 7 are directly connected by soldering to the socket boards 98. The socket boards 98 have sockets 99 mounted on them. In the present embodiment, since the intermediate connectors 6 and the socket boards 98 are directly connected, high quality test performance can be secured.

When the device side connector 8 is engaged with the engagement hole 601 of the intermediate connector 6, the terminals of the device side connector 8 are electrically connected to the output terminal 602 of the intermediate connector 6. Further, when the output terminal 602 of the intermediate connector 6 is engaged with the engagement hole 42 of the test head side connector 41, the HiFix SC and the test head 4 are electrically connected.

In the above-explained first to third embodiments, by employing the intermediate connectors 6 instead of the conventional interconnection board, the work of soldering the ends of the electrical cables 7 is eliminated, so the HiFixes 5A to 5C can be easily fabricated.

Further, when employing the conventional interconnection board, it is necessary to design the circuit wiring in advance and fabricate a specialized board. As opposed to this, in the present embodiment, by selectively connecting the device side connectors 8 to the intermediate connectors 6, it is possible to form any circuit wiring.

Further, when repairing or replacing the conventional interconnection board, the soldered locations have to be removed and the work efficiency deteriorates. As opposed to this, in the present embodiment, it is possible to repair or replace the intermediate connectors 6 by just attaching and detaching the device side connectors 8 to and from the intermediate connectors 6, so the maintenance ability is superior.

Further, when employing the conventional interconnection board, impedance mismatch occurs due to the through holes etc. and the transmission properties of the high frequency signals deteriorate. As opposed to this, in the present embodiment, since no circuit board is used, impedance mismatch can be avoided.

Further, since both the coaxial cable plugs 81 and the single-wire plugs 82 can be engaged with the first engagement parts 601 of the intermediate connectors 6, the HiFixes 5A to 5C can be reduced in cost.

In the above first to third embodiments, the example of application of the present invention to a HiFix used for testing IC devices in the packaged state was explained, but the invention is not particularly limited to this. It is also possible to apply the present invention to a wafer mother board used for testing IC devices built into a wafer as explained below.

Fourth Embodiment

Figure 21:
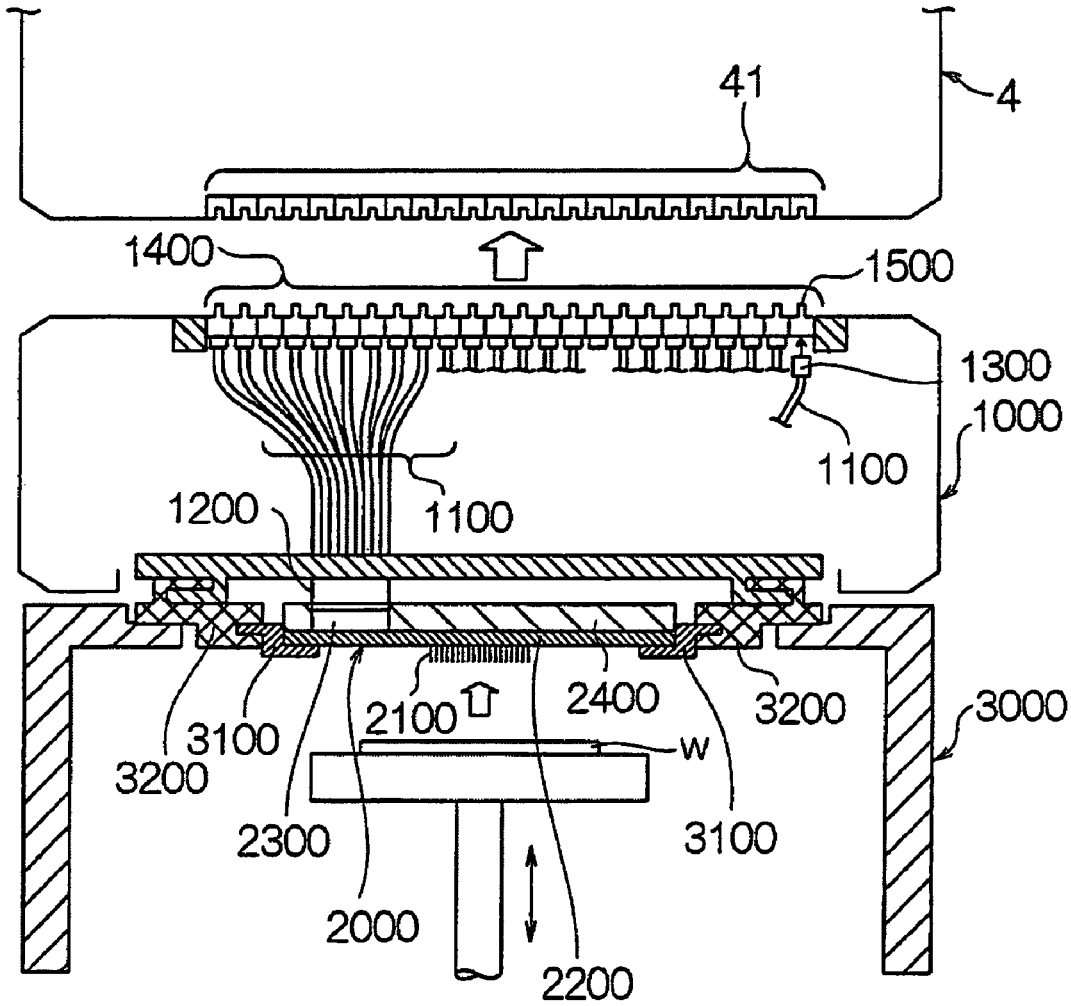
FIG. 21 is a cross-sectional view showing a wafer mother board and a test head according to a fourth embodiment of the present invention.

FIG. 21 is a cross-sectional view showing a wafer mother board and a test head according to a fourth embodiment of the present invention.

The electronic device test apparatus in the present invention is an apparatus for testing IC devices formed on a wafer W and comprises a test head 4 electrically connected to the tester (not shown) through cables (not shown); a probe card 2000 electrically contacting IC devices under test on the wafer W; and a prober 3000 pushing the wafer W to the probe card 2000.

The probe card 2000, as shown in FIG. 21, is electrically connected through the wafer mother board (interface apparatus) 1000 to the test head 4. This probe card 2000 comprises a large number of probe needles 2100 electrically contacting the input/output terminals of the IC devices on the wafer W; a printed board 2200 to which the probe needles 2100 are mounted; ZIF (Zero Insertion Force) connectors 2300 for electrically connecting the probe card 2000 to the wafer mother board 1000; and a stiffener 2400 for reinforcing the probe card 2000.

This probe card 2000, as shown in FIG. 21, is held at the ring-shaped card holder 3100 so that the probe needles 2100 face the bottom through the center opening. Further, this card holder 3100 is clamped to a ring-shaped adapter 3200.

The test head 4 has a wafer mother board 1000 mounted at its bottom. This wafer mother board 1000 has ZIF connectors 1200 provided at the bottommost part. A plurality of electrical cables 1100 are led out from the ZIF connectors 1200. At the top ends of the electrical cables 1100, in the same way as the first embodiment, device side connectors 1300 are attached. Note that as the electrical cables 1100, for example, coaxial cables for transmitting high speed signals, single wires for supplying power or transmitting low speed signals, etc. may be illustrated.

At the topmost part of the wafer mother board 1000, a plurality of intermediate connectors 1400 similar to the intermediate connectors 6 explained in detail in the first embodiment are provided in the state arranged substantially in parallel along the depth direction of the wafer mother board 1000. The engagement holes of the intermediate connectors 1400 are designed to enable attachment/detachment of the device side connectors 1300 attached to the ends of the electrical cables 1100.

In the present embodiment, unlike the first to third embodiments, the output terminals 1500 of the intermediate connectors 1400 project out upward so as to be able to engage with engagement holes of the test head side connectors 41 provided at the bottommost part of the test head 4.

When a device side connector 1300 is engaged with the intermediate connector 1400, the terminals of the device side connector 1300 are electrically connected to the output terminals 1500 of the intermediate connector 1400. Further, when the output terminal 1500 of the intermediate connector 1400 is engaged with the engagement hole of the test head side connector 41, the wafer mother board 1000 and the test head 4 are electrically connected.

In the above-explained fourth embodiment, by employing the intermediate connectors 1400, there is no longer any soldering work of the ends of the electrical cables 1100, so a wafer mother board 1000 can be easily fabricated. Further, by selectively connecting the device side connectors 1300 to the intermediate connectors 1400, any circuit wiring can be formed. Further, repair and replacement of the intermediate connectors 1400 are possible by just detaching the device side connectors 1300 from the intermediate connectors 1400, so the maintenance ability is superior. Further, in the present embodiment, no circuit board is used, so impedance mismatch can be avoided. Further, since both coaxial cable plugs and single-wire plugs can be engaged with the first engagement parts of the intermediate connectors 1400, the wafer mother board 1000 can be reduced in cost.

Note that the above-explained embodiments were described in order to facilitate understanding of the present invention and were not described in order to limit the present invention. Therefore, the elements disclosed in the above embodiments include all design modifications and equivalents belonging to the technical scope of the present invention.

In the present invention, without regard to directly or indirectly, it is sufficient that the socket boards 98 and the electrical cables 7 be electrically connected. For example, like with the SBC type of the first embodiment or the CLS type of the second embodiment, the present invention can be applied even if the socket boards 98 and the electrical cables 7 are indirectly connected through the intermediate terminals 96 or the connectors 92 between the socket boards 98 and the electrical cables 7. Further, as with the CCN type of third embodiment, the present invention can be applied even if the socket boards 98 and the electrical cables 7 are directly connected.

Further, in the above-mentioned embodiments, it is explained that the device side connectors 8 insert into the engagement holes 601 of the intermediate connectors 6, but the present invention is not particularly limited to this. For example, it is also possible to provide the device side connectors 8 with engagement holes and provide projecting parts at top surfaces of the intermediate connectors 6 and insert the intermediate connectors 6 into the device side connectors 8.

In the same way, in the above-mentioned embodiments, it is explained that the output terminals 602 projecting out from the intermediate connectors 6 insert into the engagement holes 42 of the test head side connectors 41, but the present invention is not particularly limited to this. For example, it is also possible to provide engagement holes at the bottom surfaces of the intermediate connectors 6 and provide the test head side connectors 41 with the projecting parts, and insert the test head side connectors 41 into the intermediate connectors 6.

The invention claimed is:

1. A connector assembly comprising:

a coaxial connector attached to one end of a coaxial cable having a center conductor and a ground wire;

a single-wire connector attached to one end of a single wire, and an intermediate connector to which the coaxial connector and the single-wire connector is detachably connected, wherein the intermediate connector has a first engagement part having a shape with which the coaxial connector and the signal-wire connector can be selectively engaged, the coaxial connector has a signal terminal to which the center conductor is electrically connected and first and second ground terminals to which the ground wire is electrically connected, and the single-wire connector has first to third single-wire terminals to which three single wires are electrically connected.

2. The connector assembly as set forth in claim 1, wherein the first engagement part has first to third output terminals, when the coaxial connector is engaged with the first engagement part, the signal terminal is electrically connected to the first output terminal and the first and second ground terminals are electrically connected to the second and third output terminals, and, when the single-wire connector is engaged with the first engagement part, the first to third single-wire terminals are electrically connected to the first to third output terminals.

3. The connector assembly as set forth in claim 1, wherein the first engagement part has a locking device which fastens the coaxial connector or the single-wire connector engaged with the first engagement part and the coaxial connector and the single-wire connector have an engagement projection for engagement by the locking device.

4. The connector assembly as set forth in claim 1, wherein the intermediate connector has a connector body at which a plurality of the first engagement parts are provided, and the connector body of the intermediate connector has a second engagement part with which a board side connector electrically connected to a circuit board can be engaged.

5. An interface apparatus mounted on a test head for testing a device under test and interconnecting an electrical connection between the device under test and the test head, wherein the interface apparatus comprises a connector assembly as set forth in claim 4, the intermediate connector is provided at a position adjoining the test head in the interface apparatus, the other end of the electrical cable is electrically connected to a measurement board electrically contacting the device under test, and the board side connector is electrically connected to the test head.

6. A receptacle connector able to receive either a coaxial cable plug connector to which a coaxial cable is connected or a single-wire plug connector to which a plurality of single wires are connected, wherein the receptacle connector comprises:

a first group of contacts, for electrical connection with the coaxial cable plug connector, including a first signal contact and a pair of ground contacts positioned symmetrically about the first signal contact;

a second group of contacts, for electrical connection with the single-wire plug connector, including the first signal contact and a pair of second signal contacts positioned at two points which are in an equal distance from the first signal contact; and an insulative housing for holding the first group of contacts and the second group of contacts.

7. The receptacle connector as set forth in claim 6, wherein the second signal contacts of the second group of contacts are arranged at either side of a line connecting the pair of ground contacts as seen from the engagement face.

8. The receptacle connector as set forth in claim 6, wherein the pair of ground contacts are parallel plate-shaped members arranged at symmetric positions about the first signal contact.

9. The receptacle connector as set forth in claim 6, wherein the first signal contact and the second signal contacts mutually have the same shapes.

10. The receptacle connector as set forth in claim 6, wherein one of the pair of ground contacts and one of the pair of second signal contacts positioned at the same side from the first signal contact are integrally formed.

11. The receptacle connector as set forth in claim 6, wherein the receptacle connector comprises a plurality of contact units consisting of the first group of contacts and the second group of contacts.

12. A connector assembly comprising a receptacle connector able to receive either a coaxial cable plug connector to which a coaxial cable is connected or a single-wire plug connector to which a plurality of single wires are connected; and the coaxial cable plug connector or the single-wire plug connector electrically connected to the receptacle connector, wherein the receptacle connector comprises:

a first group of contacts, for electrical connection with the coaxial cable plug connector, including a first signal contact and a pair of ground contacts positioned symmetrically about the first signal contact;

a second group of contacts, for electrical connection with a single-wire plug connector, including the first signal contact and a pair of second signal contacts positioned at two points which are in an equal distance from the first signal contact; and an insulative housing for holding the first group of contacts and the second group of contacts.

13. An interface apparatus mounted on a test head for testing a device under test and interconnecting an electrical connection between the device under test and the test head, wherein the interface apparatus comprises a connector assembly as set forth in claim 12, the intermediate connector is provided at a position adjoining the test head in the interface apparatus, the other end of the electrical cable is electrically connected to a measurement board electrically contacting the device under test, and the board side connector is electrically connected to the test head.

* * * * *